US005769957A

United States Patent [19]

Murakami et al.

[11] Patent Number: 5,769,957

[45] Date of Patent: Jun. 23, 1998

[54] REGENERATING METHOD AND APPARATUS OF IMAGE HOLDING SUPPORTING MEMBER

[75] Inventors: Kakuzi Murakami, Kamakura; Kiyoshi Tanikawa; Tadashi Saito, both of Yokohama; Toshiaki Tokita, Zama; Kiyofumi Nagai; Shigeru Fujita, both of Machida, all of Japan

[73] Assignee: Ricoh Company, Ltd., Tokyo, Japan

[21] Appl. No.: 532,568

[22] PCT Filed: Feb. 16, 1995

[86] PCT No.: PCT/JP95/00219

§ 371 Date: Oct. 16, 1995

§ 102(e) Date: Oct. 16, 1995

[87] PCT Pub. No.: WO95/22788

PCT Pub. Date: Aug. 24, 1995

[30] Foreign Application Priority Data

Feb. 16, 1994 [JP] Japan ..... 6-042050
Jan. 31, 1995 [JP] Japan ..... 7-034559

[51] Int. Cl.[6] ..... B08B 3/04; B08B 3/00

[52] U.S. Cl. ..... 134/15; 134/26; 134/32; 134/61; 134/94.1

[58] Field of Search ..... 134/15, 9, 26, 134/32, 61, 78, 94.1

[56] References Cited

U.S. PATENT DOCUMENTS 5,118,357 6/1992 Sabatka ..... 134/15
5,302,242 4/1994 Richman et al. ..... 162/5
5,474,617 12/1995 Saito et al. ..... 134/15
5,500,328 3/1996 Surash et al. ..... 430/347
5,518,581 5/1996 Miyagoshi et al. ..... 162/5
5,534,063 7/1996 Maruyama et al. ..... 118/60
5,540,815 7/1996 Igarashi et al. ..... 162/5
5,574,538 11/1996 Takahashi et al. ..... 399/71

FOREIGN PATENT DOCUMENTS 7-160158 6/1995 Japan .

*Primary Examiner*—Robert J. Warden
*Assistant Examiner*—Alexander Markoff
*Attorney, Agent, or Firm*—Oblon, Spivak, McClelland, Maier & Neustadt, P.C.

[57] ABSTRACT

In a regenerating method and apparatus of a recorded material in which at least a portion of the recorded material in the vicinity of a surface thereof on an image forming side is wet and expands with a liquid, the wet and expanding liquid (also called an image removing accelerating liquid in the following description) is provided to the recorded material so that the portion of the recorded material in the vicinity of the surface thereof is wet and expands with this liquid. A separating member comes in contact with an image forming substance having a film shape and a thermoplastic or thermally melted property and formed in the vicinity of the surface of the recorded material in a state in which joining force between the image forming substance and the recorded material is reduced. An image in the vicinity of the surface of the recorded material is transferred onto the separating member so that the image forming substance on the recorded material is removed therefrom. The image removing accelerating liquid is provided to the same recorded material plural times.

17 Claims, 14 Drawing Sheets

REGENERATING METHOD AND APPARATUS OF IMAGE HOLDING SUPPORTING MEMBER

DETAILED DESCRIPTION OF THE INVENTION

1. Technical Field

The present invention relates to a regenerating apparatus of a recorded material in which an image having a film shape is formed and recorded in the vicinity of a surface of the recorded material in an image recording method such as an electrophotographic method, a thermal transfer method, an ink jet method using hot melt-ink, a printing method, etc., and an image forming substance is removed from the unnecessary recorded material so that the recorded material is regenerated in a reusable state.

The regenerating method and apparatus of the recorded material in the present invention can be applied to various kinds of fields in which foreign matters are removed from the surface of a member such as an electronic blackboard, etc. capable of automatically erasing an image.

2. Prior Art

A large amount of printer paper and copying paper has been used by recent office automation (OA). Therefore, a large amount of paper is uselessly dumped from offices in main cases at the present time. It takes much cost to dispose this paper. Simultaneously, a regional environment becomes worse by dumping processing of this paper. Further, a global environment has recently become worse by deforestation for producing paper.

In a general treatment for solving this problem and recycling paper, ink is removed from a sheet of paper once used and this paper is decomposed into cellulose fibers and is again filtered and is reused as regenerated paper. This treatment requires a large-scale plant for regenerating the used paper. Further, it is necessary to arrange sorting, collecting and conveying processes, etc. with respect to the used paper until the regenerated paper is obtained. Furthermore, in this method, paper fibers are damaged in a regenerating operation so that paper can be regenerated about two times at most when the same paper fibers are used.

Recently, new paper has been developed. A character image is removed from this paper once used by cleaning and this paper can be used to make a copy or print. For example, in Japanese Patent Application Laying Open (KOKAI) No. 4-67043, mold-releasing processing is performed with respect to a surface of a sheetlike supporting member, especially, only one face of the supporting member. A mark is provided to this mold-released supporting member to discriminate this supporting member from (ordinary) plain paper. However, this supporting member is special paper so that it is difficult to fix an image onto this special paper. Accordingly, there is a problem when this supporting member is used as a sheet of general copying paper. Each of Japanese Patent Application Laying Open (KOKAI) Nos. 1-101576 and 1-101577 shows a method for removing an image from an image forming supporting member. In this method, an image forming substance (toner) is removed from the image forming supporting member by supersonic processing within an organic solvent for dissolving this image forming substance. However, this method has problems about pollution, ignition and toxicity by the organic solvent. Accordingly, there are problems about use in general offices and homes. Japanese Patent Application Laying Open (KOKAI) No. 1-297294 shows a cleaning method for separating an image from an image forming supporting member. In this cleaning method, the image forming supporting member is formed by plastic, a metal, paper or ceramic having low liquid permeability, etc. The image formed on the supporting member is heated through a thermally melted separating member and is separated from the supporting member. However, a sheet of special paper having a mold-released surface must be used in this cleaning method.

In Japanese Patent Application No. 5-202557, the inventors of this patent application proposed an ink separating method. In this method, a recorded material is constructed by a chartaceous layer. At least one portion of this chartaceous layer is constructed by cellulose fibers as a main component. This recorded material is impregnated with a liquid including water so that adhesive force between the chartaceous layer and ink is weakened. In this weakening state, the recorded material and a separating member come in press contact with each other so that thermally flexible ink is separated from the chartaceous layer. This method is excellent since an image formed on paper usually used can be separated therefrom and this paper can be regenerated as a recorded material and there are no problems about safety, etc. In Japanese Patent Application No. 5-96619, the inventors of this patent application proposed an apparatus construction for embodying the regenerating method proposed in Japanese Patent Application No. 5-202557. Further, it has been found from a subsequent consideration that the regenerating method of this Japanese Patent Application No. 5-202557 is effective if the recorded material is not necessarily constructed by cellulose fibers as a main component, but has a layer expanding with a liquid including water in the vicinity of a layer surface on an image forming side. The inventors of this patent application already proposed the recorded material about this technique and a method and an apparatus for regenerating this recorded material.

Concrete examples and disadvantages of the regenerating method and apparatus of the recorded material proposed by the inventors of this patent application in Japanese Patent Application Nos. 5-96619 and 5-202557 will next be described. In the following description, these regenerating method and apparatus are also respectively called a general method of the inventors of this patent application and an apparatus for executing this general method of the inventors of this patent application.

In these proposed method and apparatus, a liquid (an image removing accelerating liquid) including water is provided to the recorded material recorded in the above recording method so that adhesive force between the recorded material and an image forming substance is weakened. After adhesive force between the recorded material and an image having a film shape is weakened, the recorded material comes in contact with a separating member having adhesive force about the image forming substance stronger than the adhesive force between the recorded material and the image forming substance. Then, the recorded material and the separating member are pressurized and/or heated so that the image forming substance is transferred from the recorded material to the separating member. Thus, the image forming substance is removed from the recorded material.

FIG. 1 shows an example of the apparatus construction for executing the general method of the inventors of this patent application. A recorded material is guided from a paper feed tray 1 to a separating member roller 5 through a guide plate 3 by a paper feed roller 2 and a conveying roller 4. A surface of the separating member roller 5 is coated with an image removing accelerating liquid 7 by a liquid supplying roller 6. The recorded material conveyed from the conveying roller 4 is coated and impregnated with the image removing accelerating liquid 7. The recorded material coated and impregnated with the image removing accelerating liquid 7 and coming in contact with the separating member roller 5 comes in press contact with a heating roller 8 and is heated by this heating roller 8. Thereafter, the recorded material is separated from a separating member by a separating claw 9. An image forming substance on the separated separating member is removed from the surface of the separating member roller 5 by a cleaning portion 1F. Thus, the surface of the separating member roller 5 is again coated with the image removing accelerating liquid. In contrast to this, the recorded material separated by the separating claw 9 is guided onto a drying belt 1B by conveying rollers 1A and is dried. The dried recorded material is then discharged onto a paper discharging tray 1C by the conveying rollers 1A. The image forming substance is removed from a surface of the discharged recorded material so that the recorded material can be reused.

With respect to one of disadvantages of such a general regenerating apparatus, when paper usually used is used as the recorded material, it is necessary to separate the image forming substance from the recorded material by providing a relatively large amount of the image removing accelerating liquid to the recorded material to such an extent that this paper is approximately saturated with the image removing accelerating liquid. When such a large amount of the image removing accelerating liquid is provided to the recorded material, it is necessary to dry the provided liquid so as to finish the recorded material as a reusable material. Accordingly, energy for regenerating the recorded material is increased and no recorded material can be processed at a high speed. When general paper is used as the recorded material, this paper is wet and expands with water included in the image removing accelerating liquid so that strength of this paper is reduced. Accordingly, when a large amount of the image removing accelerating liquid is provided to the recorded material, a flexing strength of this paper is reduced in a certain case. In this case, it is difficult to convey the recorded material within the regenerating apparatus for removing the image forming substance from the recorded material. Further, the size of an entire finished paper sheet is greatly changed. To provide the large amount of the image removing accelerating liquid, it is necessary to hold a container according to this liquid amount within the regenerating apparatus so that the regenerating apparatus is large-sized. Further, when the large amount of the image removing accelerating liquid is provided to the recorded material and the recorded material is dried after removal of the image forming substance, a large amount of water as a component of the image removing accelerating liquid is evaporated from the recorded material in accordance with the providing amount of the image removing accelerating liquid. Accordingly, the concentration (humidity) of a liquid component around the regenerating apparatus is abnormally increased. The liquid component (water) is coagulated within the regenerating apparatus so that troubles about electric circuits are caused.

When the recorded material is continuously regenerated in the regenerating apparatus for executing the general method of the inventors of this patent application, coating irregularities are caused in a coating state of the image removing accelerating liquid. Further, when the image removing accelerating liquid is provided to the recorded material, the recorded material is curled and deformed in a wavy shape so that the recorded material is insufficiently conveyed within the regenerating apparatus. Accordingly, no recorded material can be regenerated at any time with high reliability.

In addition to the above disadvantages, when the same recorded material is repeatedly regenerated and reused by the general method of the inventors of this patent application, a component of the image removing accelerating liquid is accumulated in the recorded material so that various kinds of problems are caused. For example, a surfactant as a component of the image removing accelerating liquid is accumulated on a surface of paper repeatedly regenerated. Therefore, a device for recording an image is polluted and a fixing property of the image is reduced. Further, there is a case in which a coefficient of friction of a roller is reduced so that paper is slipped on this roller within the device for recording an image and is insufficiently conveyed.

OBJECTS

An object of the present invention is to solve the above-mentioned problems and disadvantages of the general technique. Namely, one object of the present invention is to provide a method and an apparatus for efficiently regenerating a recorded material without making this recorded material dirty in which an image is formed in a film shape on a surface of the recorded material in an image recording method such as an electrophotographic method, a thermal transfer method, an ink jet method using hot melt-ink, a printing method, etc.

Another object of the present invention is to solve the above-mentioned problems about the regenerating method of the recorded material in the above Japanese Patent Application No. 5-202557 proposed by the inventors of this patent application and the regenerating apparatus in Japanese Patent Application No. 5-96619. More concretely, another object of the present invention is to reduce regenerating energy, increase a processing speed of the recorded material, improve reliability of conveyance of the recorded material, reduce a change in size of the recorded material, make the regenerating apparatus compact, and remove troubles inside and outside the regenerating apparatus caused in evaporation of a large amount of an image removing accelerating liquid by improving the regenerating method and apparatus proposed by the inventors of this patent application and reducing an amount of the image removing accelerating liquid required to regenerate the recorded material.

Another object of the present invention is to improve separating characteristics of the recorded material and a separating member, increase reliability of conveyance of the recorded material during regenerative processing, and reduce the restrictions of kinds of regenerable recorded materials and kinds of image forming substances.

Another object of the present invention is to increase the number of repeatable cycles for regenerating and reusing the same recorded material.

CONSTRUCTION AND OPERATION OF THE INVENTION

In the above method proposed by the inventors of this patent application, a method for impregnating a recorded material with an aqueous solution including a surfactant of relatively low concentration, etc. in one process is used as a liquid providing means for providing an image removing accelerating liquid to the recorded material so as to reduce adhesive force between the recorded material and an image forming substance. In comparison with this method, the inventors of this patent application have found that the image forming substance can be preferably removed from the recorded material with smaller amount of the image removing accelerating liquid and more reliability by a method for providing the image removing accelerating liquid to the recorded material plural times.

A construction and an operation of the regenerating method and apparatus of the recorded material in accordance with the present invention will next be explained in detail.

Many methods for forming an image as a so-called hard copy on the recorded material are generally proposed. For example, there are an electrophotographic method using dry type toner and wet type toner, a thermal transfer method using a thermally melted ink sheet, a thermal diffusive transfer method using thermal diffusive dyes, an ink jet method, a heat sensitizing recording method using a material colored by heat, a silver salt photographic method, a printing method using offset printing, intaglio, relief printing, hole printing, etc. In these image forming methods generally used, the recorded material relative to the regenerating method of the present invention uses a thermoplastic or thermally melted image forming substance normally used in the electrophotographic method, the thermal transfer method, the ink jet method using hot melt-ink, the printing method, etc. The image forming substance is formed and recorded in a film shape in the vicinity of a surface of the recorded material. In this case, the film shape does not necessarily mean that an entire image forms one film. The film shape also means simply that no image forming substance deeply permeates the interior of the recorded material. The film shape further means that no image forming substance almost attains a state in which the image forming substance is adsorbed to the recorded material at a molecular level such as a printing case of water-soluble ink including dyes. Accordingly, for example, when an image is printed by the electrophotographic method using dry type toner and is cut (broken) within one character and one toner particle attains an independently existing state, this image is considered as the film-shaped image as an object of image removal in the regenerating method of the present invention from a removing principle thereof when this particle does not permeate the recorded material until a deep interior of the recorded material. The present invention relates to a method and an apparatus capable of regenerating and reusing the recorded material recorded by an image forming method in which the image is formed in a film shape in the vicinity of a surface of the recorded material.

The recorded material used in the present invention may be constructed by laminating chartaceous layers with each other on at least an image forming face of a plastic film and a sheet of general recording paper having cellulose fibers as a main component in the vicinity of at least a surface of the recorded material having the image forming substance to be removed. The recorded material in the present invention may be also constructed by arranging a layer showing a wet expanding property with respect to the image removing accelerating liquid in the vicinity of a surface of the recorded material. A sheet of paper commercially sold and having about 20 to 200 $\mu$m in thickness among these recorded materials is cheap in price and is easily obtained so that this paper sheet is preferable as the recorded material in the present invention.

A separating member used in the present invention is a member for transferring and separating the image forming substance from the recorded material by making the image forming substance on the recorded material adhesive to this separating member. It is necessary to construct the separating member by a material having adhesive and heat resisting properties to a certain extent with respect to the image forming substance. For example, the material of the separating member can be constructed by using synthetic rubber such as isoprene rubber, Neoprene rubber, chloroprene rubber, silicon rubber, butadiene rubber, fluorine rubber, etc., natural rubber, epoxy resin such as bisphenol epichlorohydrin condesate, etc., alkyd resin, amino resin such as urea formaldehyde resin, butyl urea formaldehyde resin, butyric melamine formaldehyde resin, benzoguanamine formaldehyde resin, etc., phenol thermosetting resin such as terpene phenol resin, phenol ether resin, phenol resin, etc., polyvinyl chloride, polyvinylidene chloride, vinyl polymer such as vinylidene chloride-acrylonitrile copolymer, vinyl chloride-vinyl acetate copolymer, ethylene-vinyl acetate copolymer, ethylene-tetrafluoroethylene copolymer, polyvinylidene fluoride, vinyl copolymer polyvinyl butyral, polyvinyl formal, polypropylene, polyethylene, etc., acrylic resin such as polybutyl acrylate, polymethacrylic acid, polymethyl methacrylate, etc., polyimide, polyamide such as 6, 6-nylon, 6-nylon, etc., polycarbonate, polyether sulfone, polyether ether ketone, polyethylene terephthalate, polyethylene naphthalate, polyester such as aromatic polyester, etc., thermoplastic or thermosetting synthetic resin such as polyphenylene sulfide, polyparabanic acid, polyether nitrile, aramid, etc., a metal such as nickel, iron, aluminum, etc., an oxide thereof, Ni-steel, stainless steel, a metallic alloy such as a Fe-Ni alloy, a Co-Al alloy, Monel, Inconel, duralumin, etc.

The above thermoplastic or thermosetting synthetic resin may be used independently or may be used in mixture. Additives such as titanium oxide particles, silica particles, carbon particles, etc. can be included in this synthetic resin. For example, a ceramic material, etc. can be included in this synthetic resin. These materials can be used independently, but can be also laminated and alloyed to improve durability, separating characteristics, etc. These materials can be further used in mixture by adding other additives such as glass fibers, whiskers, carbon, silica, titanium oxide, etc. to these materials.

An optimum material of the separating member should be selected by a kind of the image forming substance to be separated, a process condition for removing the image forming substance, etc. It is advantageous to repeatedly use the separating member in view of various kinds of points such as a reduction in regenerating cost, etc. In this case, a relatively high heat-resisting property and a stable surface property of the separating member are required. For example, in consideration of image removing characteristics and durability, the separating member is preferably constructed by polyethylene terephthalate, polyethylene naphthalate, polyether ether ketone, polyphenylene sulfide, polyparabanic acid, polyether nitrile, aramid, polyimide, polyether imide, stainless steel, nickel, anodized aluminium, etc.

The image forming substance can be separated from the recorded material by holding a water-soluble polymer in the recorded material instead of making the image forming substance come in direct contact with the separating member. In this case, the recorded material, the image forming substance, the water-soluble polymer and the separating member sequentially come in contact with each other so that the image forming substance can be also separated from the recorded material by adhesive force of the water-soluble polymer.

The present invention can be executed by forming the separating member in any one of a sheet shape, a block shape and a drum or roller shape.

In the present invention, the liquid (the image removing accelerating liquid) provided to the recorded material is a liquid for making a material portion near a surface of the recorded material wet and expand and reducing adhesive force between the recorded material and the image forming substance. Otherwise, the image removing accelerating liquid is a liquid having an auxiliary action in which permeation of a liquid for making the recorded material wet and expand is accelerated, etc. It is considered that the image removing accelerating liquid is constructed by various kinds of organic solvents such as ethanol, methanol, glycerol, diethylene glycol, etc. However, it is preferable to use a liquid having water as a main component since this liquid is safe with respect to a human's body and do not burn easily and there is no fear of fire, and a sheet of paper as the recorded material most generally used is preferably wet and expanded with this liquid.

When the image removing accelerating liquid is divisionally provided to the same recorded material plural times, it is not necessary to include water in the image removing accelerating liquid provided to the recorded material each of the plural times at any time. However, a liquid including water is preferably provided to the recorded material at least one time among the plural times.

When the image removing accelerating liquid obtained by the same prescription is divisionally provided to the recorded material plural times, it is preferable to use the image removing accelerating liquid set such that surface tension of the image removing accelerating liquid is adjusted to 50 mN/m or less. When the image removing accelerating liquid having the adjusted surface tension equal to or smaller than 50 mN/m is used, wettability of the image removing accelerating liquid with respect to the recorded material and the image forming substance on this recorded material is increased so that a permeating speed of the image removing accelerating liquid in the vicinity of a surface of the recorded material is increased. Therefore, it is possible to process the recorded material at a high speed and make a processor of this recorded material compact.

The surface tension of the image removing accelerating liquid will next be described further. A static surface tension of the image removing accelerating liquid is preferably adjusted to 50 mN/m or less. However, to cope with the high speed processing of the recorded material, for example, a dynamic surface tension of the image removing accelerating liquid measured by a vibrating jet method, a liquid drop weighting method, a bubble pressure method, etc. is further preferably adjusted to 50 mN/m or less. For example, it is possible to adjust and manufacture an image removing accelerating liquid usable in the present invention in which the surface tension of the image removing accelerating liquid is adjusted to 50 mN/m or less by adding the following surfactant to water.

Namely, the image removing accelerating liquid of the present invention can constructed by using any one of the following anionic, cationic, nonionic, amphoteric surfactants.

For example, the nonionic surfactant is constructed by polyoxyethylene alkylether class, polyoxyethylene alkylphenyl ether class, polyoxyethylene alkylester class, polyoxyethylene alkylsorbitan ester class, polyoxyethylene alkylamine class, glycerol fatty acid ester class, decaglycerol fatty acid ester class, polyglycerol fatty acid ester class, sorbitan fatty acid ester class, propylene glycol fatty acid ester class, polyethylene glycol fatty acid ester class, polyoxyethylene polyoxypropylene alkyl ether class, polyoxyethylene polyoxypropylene block polymer class, perfluoroalkyl phosphate class, polyoxyethylene denatured polydimethyl cyclohexane class, etc.

The anionic surfactant is constructed by higher fatty acid salt, N-acyl amino acid salt, polyoxyethylene alkyl ether carboxylate, acylated peptide, alkyl sulfonate, alkyl benzene sulfonate, alkyl naphthalene sulfonate, mono or dialkyl sulfo succinate, α-olefin sulfonate, N-acyl sulfonate, alkyl sulfate, polyoxyethylene alkyl ether sulfate, polyoxyethylene alkyl allyl ether sulfate, alkyl amide sulfate, monoalkyl phosphate, dialkyl phosphate, trialkyl phosphate, monopolyoxyethylene alkyl ether phosphate, bispolyoxyethylene alkyl ether phosphate, trispolyoxyethylene alkyl ether phosphate, polyoxyethylene alkyl allyl ether phosphate, perfluoroalkyl carboxylate, perfluoroalkyl sulfonate, perfluoroalkenyl allyl sulfonate, N-perfluorooctane sulfonyl glutamate, perfluoro alkyl-N-ethyl sulfonyl glycine salt, 3-(ω-fluoroalkanoyl-N-ethyl amino)-1-propane sulfonate, perfluoroalkyl ethyl phosphate, carboxylic acid denatured polydimethyl cyclohexane, sulfonic acid denatured polydimethyl cyclohexane, etc.

The cationic surfactant is constructed by higher alkyl amine salt, higher alkyl quaternary ammonium salt, alkyl benzene amine salt, alkyl benzene quaternary ammonium salt, alkyl heterocyclic quaternary ammonium salt, etc.

The amphoteric surfactant is constructed by betaine, amino carboxylic acid, etc.

Each of the above surfactants may be constructed by one kind of mixture, two or more kinds of mixtures.

A surfactant is not necessarily used to reduce the surface tension of the image removing accelerating liquid or improve its wettability with respect to the recorded material and the image forming substance. For example, effects similar to those of the surfactant can be obtained by adding an alcohol class such as methanol, ethanol, etc., and a water-soluble organic compound such as acetone, carbitol, sorbitol, etc. to the image removing accelerating liquid.

It is also preferable to add a water-soluble polymer to the image removing accelerating liquid in the present invention. The water-soluble polymer can provide an adhesive property of the image forming substance to the separating member as mentioned above. Further, the water-soluble polymer has effects of improving a finishing quality of the recorded material by improving rigidity of the recorded material after the image forming substance is separated from the recorded material.

A concrete example of the water-soluble polymer compound usable as the image removing accelerating liquid in the present invention can be constructed by carboxymethyl cellulose, polyvinyl alcohol, starch, alginic acid salt, gum arabic, gelatin, polyacrylate, polymethacrylate, hydrolysis compound salt of stylene-maleic anhydride copolymer, hydrolysis compound salt of stylene-isobutylene-phthalimide copolymer, hyaluronic acid, jerangum, condensate of naphthalene sulfonic acid and formalin, polyvinyl allyl sulfonate, water-soluble polyamide, hydroxyethyl cellulose, polyvinyl pyrrolidone, polyacrylic amide, etc.

When only the image removing accelerating liquid substantially obtained by only one prescription is provided to the recorded material, contents of the surfactant or the water-soluble polymer within the image removing accelerating liquid provided to the recorded material plural times are approximately equal to each other. In a method using such a surfactant or water-soluble polymer, the surfactant and/or the water-soluble polymer is preferably added to the image removing accelerating liquid such that the contents of the surfactant and/or the water-soluble polymer range from 0.01 to 20 wt % of the image removing accelerating liquid. In particular, the contents of the surfactant and/or the water-soluble polymer preferably range from 0.1 to 2 wt % of the image removing accelerating liquid.

When the contents of the surfactant and/or the water-soluble polymer are equal to or smaller than 0.01 wt % of the image removing accelerating liquid, the image removing accelerating liquid slowly permeates the recorded material so that it is difficult to regenerate the recorded material at a high speed. Further, no image removing accelerating liquid permeates an interface between the image f orm ing substance and the recorded material. Therefore, removing characteristics of the image forming substance, etc. are reduced. In contrast to this, when the contents of the surfactant and/or the water-soluble polymer are equal to or greater than 20 wt % of the image removing accelerating liquid, a component of the image removing accelerating liquid is accumulated into the recorded material by repeatedly regenerating the recorded material. Therefore, rerecording characteristics of the regenerated recorded material are reduced and it is difficult to dry the recorded material after an image is removed from the recorded material.

In the present invention, it is preferable to provide the image removing accelerating liquid to the recorded material at plural stages. The image removing accelerating liquid may be divisionally provided to the recorded material at plural stages according to providing objects of the image removing accelerating liquid. However, normally, a reproducing operation and the regenerating apparatus become complicated and there is no great difference in the following effects even when the stages are divided into many stages. Accordingly, it is most preferable to divisionally provide the image removing accelerating liquid to the recorded material at two stages.

In a method for divisionally providing the image removing accelerating liquid obtained by the same prescription to the recorded material plural times, it is possible to obtain effects of reducing a providing amount of the image removing accelerating liquid required to remove the image forming substance in comparison with only a single providing case of the image removing accelerating liquid. The reasons for these effects are not necessarily apparent. However, it is presumed that the recorded material is wet and expands with the image removing accelerating liquid first provided to a certain extent. Therefore, cracks are caused in the image forming substance on the recorded material. Further, a small clearance is caused between a lower portion of the image forming substance and the recorded material. Therefore, the next provided image removing accelerating liquid easily permeates efficiently a contact portion between the image forming substance and the recorded material. It is presumed that this efficient permeation contributes to the above reduction in providing amount of the image removing accelerating liquid. The recorded material and the image forming substance attain a state in which surfaces of the recorded material and the image forming substance are easily wet with the image removing accelerating liquid as another action by providing the first image removing accelerating liquid to the recorded material. Accord ingly, it is presumed that the image removing accelerating liquid uniformly permeates a relatively shallow portion of the recorded material so that the image forming substance can be preferably removed from the recorded material by a small amount of the image removing accelerating liquid. Ordinary paper is an ununiform recorded material in which cellulose fibers entwine each other. Therefore, when the image removing accelerating liquid is provided to the recorded material at one time, the image removing accelerating liquid permeates the paper ununiformly in its depth direction until a deep depth of the paper by irregularities of wettability of the paper. Wet and expansion of the recorded material in the vicinity of a contact portion between the image forming substance and the recorded material contribute to a reduction in adhesive force between the image forming substance and the recorded material.

The providing amount of the image removing accelerating liquid can be reduced by increasing wettability of the image removing accelerating liquid with respect to the recorded material and the image forming substance by the first provided image removing accelerating liquid. Accordingly, if this effect can be sufficiently obtained by the first provided image removing accelerating liquid, a sufficient permeating speed can be obtained even when surface tension of the next provided image removing accelerating liquid is relatively high and wettability of this image removing accelerating liquid is low. Accordingly, it is possible to reduce the concentration of a surfactant within the image removing accelerating liquid provided in a subsequent process. No unnecessary surfactant is provided to the recorded material when the concentration of a surfactant within the image removing accelerating liquid provided in a subsequent process is reduced. Accordingly, it is possible to solve various kinds of problems about a reduction in writing characteristics of the regenerated recorded material, a reduction in quality of a recorded image at a rerecording time, a reduction in fixing property of the image forming substance, a bad influence on a recorder, etc. When the image removing accelerating liquid provided in the subsequent process has lower wettability, this image removing accelerating liquid permeates the ununiform recorded material such as paper uniformly and shallowly. Therefore, the image forming substance can be preferably removed from the recorded material by an action similar to the above-mentioned action with a smaller amount of the image removing accelerating liquid in comparison with a case in which the image removing accelerating liquid having the same wettability is provided to the recorded material.

In the above description, the image removing accelerating liquid is divisionally provided to the recorded material plural times such that a surfactant concentration of the image removing accelerating liquid is reduced as the image removing accelerating liquid is provided to the recorded material in a later process. Thus, preferable removing characteristics of the image forming substance can be obtained even when the providing amount of the image removing accelerating liquid is reduced. In this method, it is also effective to provide the image removing accelerating liquid to the same recorded material three times or more while the image removing accelerating liquid having the surfactant concentration changed at three stages or more is used and this surfactant concentration is gradually changed every coating process. However, the inventors of this patent application have found that the image forming substance can be sufficiently removed from the recorded material by normally combining two kinds of liquids composed of a liquid including a surfactant of high concentration and a liquid including a surfactant of low concentration or including no surfactant. The construction of a liquid providing device is simplified by using only two kinds of liquids composed of a high concentration liquid and a low concentration water-soluble liquid so that the regenerating operation of the recorded material is preferably simplified.

The high concentration liquid preferably includes a surfactant of high concentration ranging from 5 to 100 weight % in the providing method of the image removing accelerating liquid in which the surfactant-including concentration of the image removing accelerating liquid divisionally provided to the same recorded material plural times is reduced as the image removing accelerating liquid is provided to the recorded material in a later process. When the surfactant concentration in the high concentration liquid is equal to or smaller than 5 weight %, no sufficient effects of preferably removing the image forming substance from the recorded material can be obtained when a small amount of the image removing accelerating liquid is provided to the recorded material in the present invention. The surfactant concentration of the high concentration liquid particularly ranges from 5 to 50 weight % so as to preferably remove the image forming substance from the recorded material, and obtain suitable values of physical properties for providing the image removing accelerating liquid to the recorded material, and repeatedly perform the regenerating operation many times by image formation and removal of the image forming substance using the same recorded material.

In contrast to this, the low concentration water-soluble liquid includes a surfactant of concentration equal to or smaller than 5 weight % or includes no surfactant. For example, the low concentration water-soluble liquid preferably uses a water-soluble polymer, an aqueous solution including only an antiseptic mildewproofing agent, or a liquid constructed by only water. When the surfactant concentration within the low concentration water-soluble liquid is equal to or greater than 5 weight %, characteristics of the regenerated recorded material are changed although there are conditions capable of separating the image forming substance from the recorded material. Further, writing characteristics of the recorded material are reduced and an image quality at a recopying time is reduced. Furthermore, wrinkles of the recorded material tend to be caused at the recopying time and the number of regenerable times of the recorded material is reduced. In particular, a preferable concentration range of the surfactant as the low concentration water-soluble liquid is equal to or smaller than 1 weight % so as to sufficiently remove the image forming substance preferably from the recorded material, and provide a preferable quality of the above regenerated recorded material, and repeatedly regenerate and use the recorded material.

When general wood free paper (fine quality paper) is used as the recorded material, the high concentration liquid is provided onto at least a holding face of the recorded material holding the image forming substance in a range from 16 $\mu g/cm^2$ to 1.6 $mg/cm^2$ (0.01 to 1 g per size A4). Thereafter, the low concentration water-soluble liquid or water is provided onto this holding face in a range from 16 $\mu g/cm^2$ to 3.2 $mg/cm^2$ (0.01 to 2 g per size A4). Thus, a very preferable recorded material can be regenerated. When a providing amount of the high concentration liquid is equal to or smaller than 16 $\mu g/cm^2$ (0.01 g per size A4) and a providing amount of the low concentration water-soluble liquid or water is equal to or smaller than 16 $\mu g/cm^2$ (0.01 g per size A4), it is impossible to sufficiently separate the image forming substance from the recorded material.

In contrast to this, when the providing amount of the high concentration liquid is equal to or greater than 1.6 $mg/cm^2$ (1 g per size A4), the image forming substance can be preferably separated from the recorded material. However, characteristics of the regenerated recorded material are changed so that writing characteristics of the recorded material are reduced. Further, an image quality is reduced when an image is again formed on the recorded material regenerated by making a copy, etc. Further, when a copy is again made by a copying machine, wrinkles tend to be caused in the recorded material. Further, the number of regenerable times of the recorded material is reduced. Furthermore, when a large amount of the high concentration liquid is provided to the recorded material, a paper strength of the recorded material is reduced so that a paper jam is easily caused. Therefore, there is a case in which separating characteristics of the image forming substance are reduced in a certain kind of used surfactant.

When the providing amount of the low concentration water-soluble liquid or water is equal to or greater than 3.2 $mg/cm^2$ (2 g per size A4), the paper strength of the recorded material is reduced so that a paper jam is easily caused and wrinkles are also caused easily in the recorded material. Further, similar to the case of providing a large amount of the image removing accelerating liquid to the recorded material at one stage, a large amount of power consumption is required and the recorded material tends to extend.

Here, an action of effects obtained by using two kinds of image removing accelerating liquids composed of the high concentration liquid and the low concentration water-soluble liquid or water will next be explained in detail. For this explanation, a phenomenon caused by providing the high concentration liquid onto an image holding face of the recorded material holding the image forming substance will first be explained briefly with reference to FIG. 2. As shown in FIG. 2, a surfactant molecule is generally constructed by a hydrophilic group 201 and a hydrophobic group (lipophilic group) 202. An image forming substance 203 shows a hydrophobic property. Accordingly, when a surfactant concentration of an image removing accelerating liquid 20 is low, no image removing accelerating liquid 20 is easily attached or adsorbed onto the image forming substance 203 when the image removing accelerating liquid 20 is particularly constructed by a solution mainly having water. Accordingly, the image removing accelerating liquid 20 tends to be repelled on the image forming substance 203. Therefore, for example, in liquid provision at one time, as shown in FIG. 3(*a*), the image removing accelerating liquid permeates a recorded material 10 in a nonexisting portion of the image forming substance 203 until a deep portion of the recorded material 10. Accordingly, no image removing accelerating liquid exists on a surface of the image forming substance 203 and an interface between the recorded material 10 and the image forming substance 203. In particular, when an attaching amount of the image removing accelerating liquid 20 provided to the recorded material 10 is changed in accordance with a permeating speed as in a coating case of the image removing accelerating liquid 20 using a roller, the permeating speed in a texture portion of the recorded material is higher than that in an image portion. Accordingly, a large amount of the image removing accelerating liquid 20 permeates only the texture portion which does not contribute to a reduction in adhesive force between the image forming substance 203 and the recorded material 10. Therefore, the large amount of the image removing accelerating liquid 20 must be provided to the recorded material 10 to such an extent that the image removing accelerating liquid 20 approximately permeates the entire recorded material 10 so as to make the image removing accelerating liquid 20 approximately permeate the interface between the image forming substance 203 and the recorded material 10. In contrast to this, when the image holding face is coated with a small amount of the high concentration liquid, as shown in FIG. 3(*b*), the hydrophobic group of the surfactant is adsorbed to the image forming substance so that the recorded material 10 and the image forming substance 203 are entirely wet with the high concentration liquid. It is presumed that viscosity of the high concentration liquid is relatively high and fluidity of the high concentration liquid is relatively low so that the high viscosity and the low fluidity also contribute to the uniform provision of the high concentration liquid on the recorded material 10. There is a possibility that a slight amount of the high concentration liquid approximately reaches the interface between the image forming substance 203 and the recorded material 10 through a clearance of the image forming substance 203. This possibility can be presumed by confirming from observation of a microscope, etc. that a full image having a large area has a structure having many holes in its interior. When the high concentration liquid is provided to the recorded material and the low concentration water-soluble liquid or water is then provided to the recorded material, the high concentration liquid exists on the image forming substance 203 in advance so that the low concentration water-soluble liquid is not repelled, but is approximately uniformly provided onto surfaces of the recorded material 10 and the image forming substance 203. As mentioned above, water approximately permeating the interface of the recorded material 10 and the image forming substance 203 contributes to a reduction in adhesive force between the recorded material 10 and the image forming substance 203. However, the image forming substance can be preferably separated from the recorded material by providing the image removing accelerating liquid to the recorded material in the regenerating method of the present invention using the above-mentioned action with a small amount of the image removing accelerating liquid in comparison with a case in which the entire recorded material 10 is impregnated with the image removing accelerating liquid.

In the method using two kinds of image removing accelerating liquids composed of the high concentration liquid and the low concentration water-soluble liquid, a large amount of the surfactant within the provided image removing accelerating liquid distributes to a material portion near a surface of the recorded material in comparison with the general providing method in which the image removing accelerating liquid is provided to the recorded material at only one time. Therefore, when the image forming substance comes in press contact with a separating member and is adhered and transferred to the separating member in a certain kind of surfactant used in the image removing accelerating liquid, this surfactant takes an action for preventing the image forming substance once transferred onto the separating member from being again transferred (reattached) to the recorded material. It is presumed that this action is one of the reasons causing effects of improving removing characteristics of the image forming substance as mentioned above.

When the recorded material uses a bulky material having a permeating property such as paper (a liquid can permeate from a front face of the recorded material to a rear face thereof, or can permeate from the rear face of the recorded material to the front face thereof), the inventors of this patent application have found that the image forming substance can be effectively separated from the recorded material by providing the low concentration water-soluble liquid from a face (image non-holding face) opposite to the image holding face of the recorded material after the high concentration liquid is provided to this image holding face of the recorded material. In particular, there is a case in which it is difficult to make the image removing accelerating liquid pass and permeate the image forming substance since an attaching amount of the image forming substance is large and the image forming substance is completely formed in a film shape. In this case, the image forming substance can be more preferably removed from the recorded material by providing the low concentration water-soluble liquid from the non-image face in comparison with a case in which the low concentration water-soluble liquid is provided from the image holding face of the recorded material. When the recorded material is thick and a liquid having low permeability is used as the low concentration water-soluble liquid, it is not necessarily preferable to make the low concentration water-soluble liquid permeate from the non-image holding face. However, when a sheet of plain paper having a thickness equal to or smaller than 100 microns is used, the image forming substance can be more preferably removed from the recorded material by providing the low concentration water-soluble liquid from the non-image face in comparison with a case in which the low concentration water-soluble liquid is provided to the recorded material from the image holding face thereof by adding a suitable permeating agent to the low concentration water-soluble liquid.

In a method for providing this low concentration water-soluble liquid from a rear face of the recorded material, the high concentration liquid preferably includes a surfactant of high concentration ranging from 5 to 100 weight %. When the surfactant concentration within the high concentration liquid is equal to or smaller than 5 weight %, it is impossible to obtain effects capable of sufficiently removing the image forming substance preferably from the recorded material by providing a small amount of the image removing accelerating liquid to the recorded material. A preferable surfactant concentration of the high concentration liquid particularly ranges from 5 to 50 weight % so as to preferably remove the image forming substance from the recorded material, and obtain suitable values of physical properties for providing the image removing accelerating liquid to the recorded material, and repeatedly perform the regenerating operation many times by image formation and removal of the image forming substance using the same recorded material.

In contrast to this, the low concentration water-soluble liquid preferably uses a water-soluble liquid having high permeability and including a surfactant concentration ranging from 0.05 to 2 weight %. When the surfactant concentration of the low concentration water-soluble liquid is equal to or smaller than 0.05 weight %, it is difficult to preferably remove the image forming substance from the recorded material. In contrast to this, when the surfactant concentration of the low concentration water-soluble liquid is equal to or greater than 2 weight %, the image forming substance can be preferably separated from the recorded material. However, characteristics of the regenerated recorded material are changed and writing characteristics of the recorded material are reduced and an image quality at a recopying time is reduced. Further, wrinkles of the recorded material are easily caused at the recopying time and the number of regenerable times of the recorded material is reduced. In particular, a preferable concentration range of the surfactant as the low concentration water-soluble liquid ranges from 0.2 to 1 weight % so as to sufficiently remove the image forming substance preferably from the recorded material, and provide a preferable quality of the above regenerated recorded material, and repeatedly regenerate and use the recorded material.

In this method, with respect to a suitable providing amount of the high concentration liquid, the high concentration liquid is provided onto a holding face of the recorded material holding the image forming substance in a range from 16 $\mu g/cm^2$ to 1.6 $mg/cm^2$ (0.01 to 1 g per size A4).

With respect to a suitable providing amount of the low concentration water-soluble liquid, the low concentration water-soluble liquid is provided onto this holding face in a range from 16 $\mu g/cm^2$ to 3.2 $mg/cm^2$ (0.01 to 2 g per size A4). When the providing amount of the high concentration liquid is equal to or smaller than 16 $\mu g/cm^2$ (0.01 g per size A4) and the providing amount of the low concentration water-soluble liquid is equal to or smaller than 16 $\mu g/cm^2$ (0.01 g per size A4), it is impossible to sufficiently separate the image forming substance from the recorded material. In contrast to this, when the providing amount of the high concentration liquid is equal to or greater than 1.6 $mg/cm^2$ (1 g per size A4), or when the providing amount of the low concentration water-soluble liquid is equal to or greater than 3.2 $mg/cm^2$ (2 g per size A4), problems similar to those caused in the above case of providing both the high concentration liquid and the low concentration water-soluble liquid to the recorded material from the image face are caused.

In the method for providing the low concentration liquid to the recorded material from its rear face by using at least two kinds of image removing accelerating liquids composed of the high concentration liquid and the low concentration water-soluble liquid, it is effective to add a wetting agent into prescription of the high concentration liquid so as to improve removing characteristics of the image forming substance and reduce required amounts of the image removing accelerating liquids, etc.

Here, the wetting agent means a compound having excellent compatibility with respect to water and having a vapor pressure lower than that of water. Concretely, for example, such a compound is constructed by a polyhydric alcohol class such as ethylene glycol, diethylene glycol, triethylene glycol, tetraethylene glycol, polyethylene glycol, 1,5-pentane diol, 1,6-hexane diol, propylene glycol, dipropylene glycol, glycerol, etc., an ether class of polyhydric alcohol such as ethylene glycol monoethyl ether, ethylene glycol monomethyl ether, ethylene glycol monobutyl ether, diethylene glycol monomethyl ether, triethylene glycol monomethyl ether, tetraethylene glycol monomethyl ether, propylene glycol monomethyl ether, ethylene glycol, diethylene glycol monoethyl ether, triethylene glycol monoethyl ether, tetraethylene glycol monoethyl ether, propylene glycol monoethyl ether, etc., a heterocylic compound such as N-methyl-2-pyrrolidone, 1,3,-dimethyl imidazolidinone, $\epsilon$-caprolactam, etc., an amine class such as monoethanol amine, diethanol amine, triethanol amine, etc. The above wetting agent can be used as one kind of mixture, or two or more kinds of mixtures.

Addition of the wetting agent into prescription of the high concentration liquid is effective for the following reasons in the method for particularly providing the low concentration liquid to the recorded material from its rear face. Namely, when the recorded material is heated to transfer the image forming substance, water within the low concentration liquid evaporated by this h eating is absorbed into the wetting agent and attains a state in which moisture is condensed in the vicinity of the image holding face of the recorded material. It is presumed that this water weakens adhesive force between the image forming substance and the r ecorded material and takes an acti on for preventing the image forming substance from being refixed onto the recorded material when the image forming substance is transferred to the separating member.

In the present invention, the recorded material and the separating member come in press contact with each other and the image forming substance is separated from the recorded material in a state in which the image removing accelerating liquid is provided to the recorded material and the adhesive force between the recorded material and the image forming substance is weakened. In this method, as mentioned above, it is preferable to provide adhesive force between the image forming substance and the separating member in a heating state of the image forming substance. It is also preferable to separate the recorded material from the separating member in the heating state of the image forming substance. When a sheet of paper normally used is used as the recorded material and this paper sheet is regenerated by removing an image obtained by a normal electrophotographic method from the paper sheet so as to reuse this paper sheet, the image forming substance is heated until a temperature at which the image forming substance is softened or plasticized. Thus, the recorded material and the separating member come in press contact with each other so that the image forming substance is separated from the recorded material. Thus, the image forming substance can be preferably removed from the recorded material. After the image removing accelerating liquid is provided to the paper sheet, it is difficult to completely remove the image forming substance from the recorded material with out heating the image forming substance until its softening or plasticizing temperature when an image is separated from the recorded material by using, for example, an adhesive tape. This is because paper is usually porous and the surface of a chartaceous layer is separated from the recorded material together with the image forming substance entering into holes of this paper when the image forming substance is removed from the paper sheet without heating.

After the high concentration liquid in the present invention is provided to the image holding face of the recorded material, the recorded material is regenerated by using a providing method of the image removing accelerating liquid in which the low concentration water-soluble liquid is provided to the recorded material. When paper is used as the recorded material in this regenerating method of the recorded material, the recorded material is heated until the softening or plasticizing temperature of the image forming substance after the image removing accelerating liquid is provided to the recorded material. The recorded material and the separating member come in press contact with each other. The image forming substance is adhered and transferred to the recorded material so that the image forming substance is preferably separated from the recorded material. In particular, in the above method for providing the low concentration liquid to the recorded material from its rear face, preferable separating characteristics can be obtained by heating the recorded material such that a temperature of the recorded material on its image holding face side is lower than that on a non-image holding face side of the recorded material. This is because it is presumed that a moisture density on a recording face side is increased by setting the temperature of the recorded material on its non-image holding face to a high temperature since water within the image removing accelerating liquid existing in the vicinity of the non-image holding face side of the recorded material is moved onto the recording face side on a low temperature side by evaporation.

In the general method of providing a large amount of an aqueous solution having a surfactant of relatively low concentration to the recorded material, a large amount of the image removing accelerating liquid is consumed in regeneration of the recorded material so that there are problems about maintenance of acquisition, replenishment, etc. of the image removing accelerating liquid. When water is used as the low concentration water-soluble liquid in the above method using two kinds of image removing accelerating liquids composed of the high concentration liquid and the low concentration water-soluble liquid, a user can use the regenerating apparatus by supplying only the high concentration liquid from a maker to the user since water can be easily obtained relatively in any place. In this method, acquisition and replenishment frequencies of the image removing accelerating liquid can be reduced and supply cost of the image removing accelerating liquid can be effectively reduced. In particular, maintenance frequency of the user can be extremely reduced by directly taking city water into the regenerating apparatus. When only water is used, there is a fear of generation of various kinds of troubles caused by decomposition of water. Accordingly, for example, it is useful to arrange a mechanism for automatically adding a slight amount of antiseptic mildewproofing agent to a tank for holding the city water within the regenerating apparatus.

A construction and an operation of the regenerating apparatus of the recorded material in the present invention will next be explained.

The regenerating apparatus of the recorded material in the present invention has a means for providing the image removing accelerating liquid to the same recorded material plural times. Various kinds of regenerating methods and devices already proposed by the inventors of this patent application are basically used in a transfer portion for separating the image forming substance from the recorded material to the separating member and a finishing portion for smoothly finishing and drying the recorded material from which the image forming substance is removed.

For example, a providing device of the image removing accelerating liquid provides this image removing accelerating liquid to the recorded material by making a roller or a belt attaching the image removing accelerating liquid thereto come in close contact with the recorded material. The providing device of the image removing accelerating liquid also provides the image removing accelerating liquid to the recorded material by generating a mist liquid drop as in a sprayer, a humidifier, etc. The providing device of the image removing accelerating liquid further provides the image removing accelerating liquid to the recorded material by generating a liquid drop having a relatively large momentum as in an ink jet method.

An example of a device for providing the image removing accelerating liquid to the recorded material by rollers is shown more concretely in FIG. 4. In FIG. 4, each of these rollers is rotated in an arrow direction. A recorded material 10 is moved in an arrow direction between a coating roller 23 and a pressing roller 24 for pressing the recorded material 10 from an upper face thereof with constant weighting. A roller 22 as a drawing-up roller is arranged within a container 21 storing an image removing accelerating liquid 20 therein such that a portion of the drawing-up roller 22 is dipped into the image removing accelerating liquid 20. For example, a surface of this drawing-up roller 22 is formed by an elastic material having high wettability such as chloroprene rubber or a metal. The image removing accelerating liquid 20 is attached to the drawing-up roller 22 and is drawn up by rotating this drawing-up roller 22. An amount of the drawn-up image removing accelerating liquid 20 is measured (drawn) and adjusted to a constant amount by a gap or nip between the drawing-up roller 22 and a coating roller 23. This coating roller 23 comes in contact with the drawing-up roller 22, or is arranged in a state in which a slight gap is formed between the drawing-up roller 22 and the coating roller 23. The coating roller 23 is formed by an elastic material such as chloroprene rubber, etc., or is formed by a metallic material. The image removing accelerating liquid 20 weighted and attached onto the coating roller 23 is provided to the recorded material conveyed between the pressing roller 24 and the coating roller 23. In FIG. 4, a guide plate 25 is attached to support the recorded material 10 before and after the image removing accelerating liquid is provided to the recorded material 10. This guide plate 25 may be replaced with a conveying belt to improve conveyance of the recorded material. A method for forming concave and convex portions such as a groove, etc. in one of the drawing-up and coating rollers and changing the above wettability by surface processing is effective to adjust the providing amount of the image removing accelerating liquid provided to the recorded material to a desirable amount. It is desirable to arrange an unillustrated means for detecting a surface of the image removing accelerating liquid such that this liquid surface is approximately located in a constant position at any time. It is also desirable to arrange a liquid supplying means 260 according to this detecting means.

FIG. 5 shows an example of a device for supplying the image removing accelerating liquid 20 to the recorded material 10 by liquid dropping. In this device, the image removing accelerating liquid is pumped up by a pump 260 from a tank 261 and is pressurized. The pressurized image removing accelerating liquid 20 is injected from a nozzle arranged in a liquid injecting unit 27 through an accumulator 271 and a valve 270. In this case, pressurizing force of the image removing accelerating liquid 20 suitably ranges from 0.5 to 10 kgf/cm$^2$. A diameter of this nozzle suitably ranges from 1 to 50 $\mu$m. The number of nozzles, a nozzle density, etc. are suitably selected and used in accordance with a desirable providing amount of the image removing accelerating liquid.

All liquid drop forming devices used in a so-called ink jet recording method in addition to a liquid pressurizing system using the above pump can be used as the device for providing the image removing accelerating liquid 20 to the recorded material 10 by liquid dropping. For example, the image removing accelerating liquid providing device is constructed by a device in which a heating element is arranged within a liquid chamber and the image removing accelerating liquid is guided to this liquid chamber and is boiled by heating the heating element so that bubbles are generated to fly the image removing accelerating liquid. The image removing accelerating liquid providing device may be also constructed by a device in which a vibrating plate arranged within a liquid chamber is operated by an electric mechanical coupling element such as PZT, etc. so that the image removing accelerating liquid flies by a change in volume of the liquid chamber and a pressure wave. The image removing accelerating liquid providing device may be also constructed by a device in which vibration generated by an electric mechanical coupling element such as PZT, etc. is converged by an acoustic lens and a mist of the image removing accelerating liquid is generated from a face thereof. The image removing accelerating liquid providing device may be further constructed by a device in which a liquid drop of the image removing accelerating liquid is absorbed by electrostatic force using a high electric field to fly the image removing accelerating liquid.

The image removing accelerating liquid 20 is provided to the recorded material 10 by one of these devices. A desirable number of these devices may be arranged to provide the image removing accelerating liquid to the recorded material plural times. The above roller coating device and the liquid drop forming device can be used in a suitable combination.

FIG. 6 shows an apparatus construction for providing the image removing accelerating liquid to the recorded material by arranging roller coating parts at four stages. These parts may have the same construction. Otherwise, constructions of these parts may be changed in accordance with characteristics of the image removing accelerating liquid 20, etc.

FIG. 7 shows an apparatus construction in which a coating belt 231 and a pressing belt 290 are respectively used instead of the coating roller 23 and the pressing roller 24 shown in FIG. 6. Each of these belts also functions as a conveying belt at the next stage in the apparatus construction using the coating belt 231 and/or the pressing belt 290 so that conveyance of the recorded material is improved. FIG. 8 particularly shows an example in which a supplying source (tank) of the image removing accelerating liquid 20 is commonly used when the image removing accelerating liquid 20 is processed by the same prescription and is used at each of stages. It is easy to perform a maintaining operation of the regenerating apparatus such as liquid supply by commonly using the tank. In the regenerating apparatus shown in FIG. 8, a pump 260 is arranged every liquid providing part. When the image removing accelerating liquid 20 overflowing from a liquid container 21 is recollected to the tank 261, stable separating characteristics of the recorded material can be obtained since liquid prescriptions in the respective liquid providing parts are approximately equal to each other at any time even when composition of the image removing accelerating liquid is changed by evaporation of liquid components, etc. When the liquid providing parts are arranged at many stages, tanks at second and subsequent stages may be commonly used if, for example, a high concentration liquid is provided to the recorded material at a first stage and a low concentration water-soluble liquid or water obtained by the same prescription is provided to the recorded material at the second and subsequent stages instead of a structure using the image removing accelerating liquid 20 provided by the same prescription in all liquid providing means.

In the liquid providing device shown in FIG. 4, the pressing roller becomes wet with the image removing accelerating liquid in a construction for making the coating and pressing rollers come in contact with each other when no liquid is provided to the recorded material, i.e., when there is no recorded material between the coating roller 23 and the pressing roller 24. Therefore, when the recorded material is conveyed, the image removing accelerating liquid is provided to a front end of the recorded material from both front and rear faces thereof. The image removing accelerating liquid attached to the pressing roller is transferred to the recorded material. Accordingly, no image removing accelerating liquid is provided to a rear face side of the recorded material, i.e., a pressing roller side at a certain distance from the front end of the recorded material. A providing distance of the image removing accelerating liquid provided to both the front and rear faces of the recorded material is determined by a diameter of the pressing roller, a contact pressure between the pressing and coating rollers, surface roughnesses of the pressing and coating rollers, etc.

A curling amount of the recorded material in a front end portion thereof in conveyance is reduced by coating at least both front and rear faces of this front end portion with the image removing accelerating liquid. Accordingly, it is clear that this coating of the image removing accelerating liquid provides great effects for improving conveying reliability of the recorded material in the regenerating apparatus. Namely, probability of a jam caused within the regenerating apparatus can be greatly reduced by coating both the faces of the recorded material in its front end portion with the image removing accelerating liquid.

When at least two liquid providing means composed of means for providing the high concentration liquid and the low concentration liquid are arranged as a providing means of the image removing accelerating liquid in the regenerating apparatus of the recorded material in the present invention, it is preferable to set the providing means of the image removing accelerating liquid such that the high concentration liquid is provided to the recorded material at an earlier stage as mentioned above. In particular, a providing device of the low concentration liquid preferably uses a liquid providing means for providing the image removing accelerating liquid to the recorded material by the above liquid dropping. This is because, when a liquid providing system using a roller or a belt is used in the provision of the low concentration liquid, a component of the high concentration liquid flows into the low concentration liquid from the recorded material having the provided high concentration liquid and is mixed with the low concentration liquid so that composition of the low concentration liquid is changed. The liquid providing means for providing the image removing accelerating liquid by the liquid dropping can easily cope with constructions in which the low concentration liquid is provided to the recorded material from its rear face. The low concentration liquid has low viscosity so that the low concentration liquid is suitable for the liquid providing device using the liquid dropping as physical properties of this liquid. As mentioned above, the low concentration liquid is preferably provided to the recorded material in a range from 16 $\mu g/cm^2$ to 3.2 $mg/cm^2$ (0.01 to 2 g per size A4). The above liquid providing means using the liquid dropping is suitable for this providing amount of the low concentration liquid.

In contrast to this, the high concentration liquid has suitable physical properties. It is possible to obtain a providing amount of the high concentration liquid provided to the recorded material in a preferable range from 16 $\mu g/cm^2$ to 1.6 $mg/cm^2$ (0.01 to 1 g per size A4). Accordingly, the high concentration liquid can be uniformly provided stably to the recorded material by each of a roller system and a belt system.

In the above description, the device having the providing parts of the image removing accelerating liquid at many stages is illustrated when the image removing accelerating liquid is provided to the recorded material by the liquid providing means plural times. When the image removing accelerating liquid obtained by the same prescription is provided to the recorded material plural times, plural liquid providing means are not necessarily required. In this case, the image removing accelerating liquid can be provided to the recorded material plural times by arranging a conveying means such that the recorded material passes through the same liquid providing means plural times.

FIGS. 10 and 11 show constructional examples of such a device. In this device, a front end of a branching claw 293 is located on the side of a coating belt 231 so as to rotate the recorded material 10 until a circumferential rotating number required to obtain a desirable liquid providing amount is provided. The front end of the branching claw 293 is located on the side of a pressing belt 290 when the desirable circumferential rotating number is provided. Therefore, a means for detecting passage of the recorded material 10 and a means for storing the number of passages of the recorded material 10 are arranged although these means are not illustrated in FIGS. 10 and 11.

In the liquid providing unit of FIG. 10, a movement of the recorded material 10 is controlled by a compressed air from an air compressor 294 such that the recorded material 10 is preferably conveyed along the branching claw 293 and the pressing belt 290. It is desirable to change a blowing direction of the compressed air in a branching portion of the recorded material 10 in association with an operation of the branching claw. The other compressed air generators 294 are preferably turned on and off in accordance with passing positions of the recorded material 10.

FIG. 11 shows another example of the device having a conveying means set such that the recorded material passes through the same liquid providing means plural times. In the liquid providing device shown in FIG. 11, a front end of the recorded material 10 is fixedly supported by a clamp 296 of a drum 295 having a clamping means. The drum 295 has a position detecting means such as a rotary encoder, etc. At a clamping time, a position of the front end of the recorded material 10 is set to be synchronized with a position of the clamp 296. The recorded material is circumferentially rotated along the drum 295. In the meantime, the drum is rotated by a set rotating number. Thus, the image removing accelerating liquid is provided to the recorded material plural times. After the image removing accelerating liquid is provided to the recorded material desirable times, the clamp 296 is operated such that a front end of the recorded material is released.

When the recorded material passes through the same liquid providing device plural times as shown in each of FIGS. 10 and 11, the liquid providing device can be made compact in comparison with a liquid providing device in which roller coating units are arranged at many stages. Further, in the liquid providing device for passing the recorded material therethrough plural times, a providing amount of the image removing accelerating liquid can be easily changed by controlling the number of passages of the recorded material when this liquid providing amount is changed in accordance with, for example, the number of regenerative processings of the recorded material.

In particular, in the device of FIG. 11, the image removing accelerating liquid is provided to the recorded material while the recorded material comes in close contact with the drum. Accordingly, when the recorded material is curled and wrinkles by the liquid provision, the image removing accelerating liquid can be stably provided to the recorded material without causing any defect in conveyance such as a jam, etc.

In the above method using at least two kinds of image removing accelerating liquids composed of the high concentration liquid and the low concentration water-soluble liquid, water is used as the low concentration water-soluble liquid and maintenance of the regenerating apparatus is improved and running cost of the regenerating apparatus can be reduced by particularly using city water.

For example, a device for executing this method is constructed by arranging an intake port of city water directly connected to the tank 261 in the device of FIG. 4. In this case, this executing device has a means for flowing the city water into the tank by opening a valve when a liquid amount within the tank is equal to or smaller than a constant amount.

FIG. 12 shows a modified example of the unit for coating the recorded material with the image removing accelerating liquid in the regenerating apparatus of FIG. 9. A device for providing the image removing accelerating liquid to the recorded material by liquid dropping instead of the roller coating is arranged as the providing device of the image removing accelerating liquid at a second stage.

FIG. 13 shows an example similar to FIG. 12. In FIG. 13, a portion of the unit for providing the image removing accelerating liquid to the recorded material in the regenerating apparatus of the recorded material shown in FIG. 9 has a construction different from that of FIG. 9. In this apparatus, the image removing accelerating liquid at a second stage is provided to the recorded material from both sides of an image holding face and an image non-holding face of the recorded material 10. The image removing accelerating liquid is provided to the recorded material from both the faces of the recorded material by using such an apparatus so that it is possible to prevent curl of the recorded material caused when the image removing accelerating liquid is provided onto only one face of the recorded material.

The providing device at the second stage in the providing unit of the image removing accelerating liquid shown in FIG. 13 will be further explained. The providing device at the second stage in the providing unit of the image removing accelerating liquid shown in FIG. 13 approximately has the same basic construction as the providing device of a roller system shown in FIG. 4. The recorded material is conveyed such that the recorded material is supported between a rear face coating roller 280 and a front face coating roller 23. A liquid supplying roller 282 for rear face coating is arranged such that this liquid supplying roller 282 comes in contact with the rear face coating roller 280. A liquid supplying nozzle 281 for rear face coating is arranged such that the image removing accelerating liquid drops between the rear face coating roller 280 and the liquid supplying roller 282 for rear face coating. A rear face coating valve 283 for controlling supply of the image removing accelerating liquid is arranged between the liquid supplying nozzle 281 for rear face coating and a liquid supplying means 260.

The rear face coating valve 283 is opened by a detecting signal from an unillustrated detecting means for detecting a front end of th e recorded material in timing in which the front end of the recorded material reaches a roller coating unit. The recorded material is then transmitted to the rear face coating roller 280. A liquid supplying amount of the recorded material is determined by a sending pressure from the liquid supplying means 260 and an opening time of the valve. The image removing accelerating liquid can be provided to both faces of the recorded material only in a front end portion thereof in accordance with objects. Otherwise, the image removing accelerating liquid may be provided onto an entire face of the recorded material. The image removing accelerating liquid drops onto the liquid supplying roller 282 for rear face coating from a nozzle. A rear face of the recorded material 10, namely, a non-image holding face side thereof is coated from the rear face coating roller 280 with an amount of the image removing accelerating liquid according to a nip width or a gap width between the liquid supplying roller 282 for rear face coating and the rear face coating roller 280.

The image removing accelerating liquid is provided to both the faces of the recorded material, etc. in the providing device of the image removing accelerating liquid at the second and subsequent stages. Such a device is particularly suitable for a regenerating apparatus of the recorded material using two or more kinds of image removing accelerating liquids composed of the high concentration aqueous solution and the low concentration aqueous solution. This is because there is no great problem about curl of the recorded material in provision of the high concentration aqueous solution, but there is a problem about curl caused by providing the low concentration water-soluble liquid since the high concentration aqueous solution includes a small amount of water and a suitable providing amount of the high concentration aqueous solution is smaller than that of the low concentration water-soluble liquid.

FIG. 14 shows a constructional example of the regenerating apparatus in which the image removing accelerating liquid at a second stage is provided to the recorded material from a face opposite to a holding face of an image forming substance 11, namely, from an image non-holding face side of the recorded material. A providing device of the image removing accelerating liquid in this regenerating apparatus has a construction similar to that of the rear face coating roller, etc. for coating a non-image face shown in FIG. 13. However, no drawing-up roller is attached to the providing device of the image removing accelerating liquid at the second stage so as not to provide the image removing accelerating liquid to an image face of the recorded material.

FIG. 15 also shows a constructional example of the regenerating apparatus in which the image removing accelerating liquid at a second stage is provided to the recorded material from a face opposite to the holding face of an image forming substance 11, namely, from a non-image holding face side of the recorded material. This providing device of the image removing accelerating liquid in the regenerating apparatus has a device for providing the image removing accelerating liquid at the second stage as a liquid drop to the recorded material. The providing device of the image removing accelerating liquid at th e second stage as a liquid drop is particularly suitable for a regenerating apparatus of the recorded material using two or more kinds of image removing accelerating liquids composed of the high concentration liquid and the low concentration aqueous solution for the above-mentioned reasons.

FIG. 16 shows an example of the providing unit of the image removing accelerating liquid in the regenerating apparatus. This providing unit has a means for judging whether or not the recorded material 10 is regeneratively processed before regenerative processing. Plural conveying paths of the recorded material 10 are arranged such that the number of liquid provisions with respect to the regeneratively processed recorded material (the regenerated recorded material) is set to be different from that with respect to an unregenerated recorded material.

In FIG. 16, a recorded material 10 fed from a paper feed tray 12 is transmitted below a regenerative processing number judging means 15 and is guided to a liquid providing unit through a conveying roller pair 16. For example, the regenerative processing number judging means 15 may be constructed by a sensor capable of reading a mark showing regeneration of the recorded material 10 at a regenerative processing time. Otherwise, the regenerative processing number judging means 15 may be constructed by a sensor capable of reading a hole, concave and convex portions formed in the recorded material by a punch, etc. at the regenerative processing time. Concretely, the regenerative processing number judging means 15 is constructed by judging the mark from a difference in reflected light amount between a mark portion and the other portions using a photoelectric switch of each of reflecting and transmitting types, etc. A signal from this regenerative processing number judging means 15 is used in position control of a branching claw 293 arranged within a liquid providing unit. In FIG. 16, when the mark is detected, i.e., when the regenerated recorded material is fed, a front end of the branching claw 293 is moved in the direction of a lower guide plate so that the recorded material 10 is guided to an upper side conveying path. The upper side conveying path is connected to a normal conveying path before a second stage such that liquid provision of the recorded material 10 at a first stage is skipped and the liquid provision of the recorded material 10 is started from the second stage. An auxiliary roller 253 may be arranged on the upper side conveying path to support conveyance of the recorded material. When a high concentration liquid is used as the image removing accelerating liquid at the first stage and a low concentration liquid is used as the image removing accelerating liquid at the second stage i n the regenerating apparatus of FIG. 16, no high concentration liquid is provided to the processed recorded material. In such a construction, it is possible to prevent a component of the image removing accelerating liquid such as a surfactant, etc. from being accumulated in the recorded material even when the recorded material is repeatedly regenerated and reused.

In the regenerating apparatus for switching conveying paths of the recorded material as shown in FIG. 16, it is possible to reliably prevent an unnecessary image removing accelerating liquid from being attached onto the recorded material so as to change the number of provisions of the image removing accelerating liquid in accordance with the number of regenerative processings of the recorded material. In the device for providing the image removing accelerating liquid to the recorded material by using a roller as shown in FIG. 10, the image removing accelerating liquid remaining in its container 21 and attached to the roller is attached to the recorded material even when the operation of a liquid supplying means (pump) is stopped and the image removing accelerating liquid is discharged from the image removing accelerating liquid container 21. Therefore, it is difficult to reliably prevent the unnecessary image removing accelerating liquid from being attached to the recorded material by only an electric control means, a mechanical means for slightly moving only one portion of the providing device of the image removing accelerating liquid, etc.

However, it is effective for simplification of the regenerating apparatus to control turning-on and turning-off operations of the providing means and switch the number of liquid provisions by using only the electric control means, the mechanical means for slightly moving only one portion of the providing device of the image removing accelerating liquid, etc. In this case, the turning-on and turning-off operations are performed and the number of liquid provisions is switched in accordance with the detected number of regenerative processings to change the number of provisions of the image removing accelerating liquid in accordance with the number of regenerative processings of the recorded material. If the image removing accelerating liquid is provided to the recorded material by a providing device using liquid dropping similar to an ink jet, the turning-on and turning-off operations of the providing means can be easily performed by electric control.

FIG. 17 shows an example of a device constructed such that city water is used as the low concentration water-soluble liquid. In FIG. 17, a drain pipe 262 is connected to a general water supply and the city water is guided to an auxiliary tank 265 through a valve 263. The low concentration water-soluble liquid is supplied from the auxiliary tank 265 such that a liquid level within a liquid container is constant. In the liquid supply, a quality of the low concentration water-soluble liquid may be improved by mixing an additive such as an antiseptic agent, a mildewproofing agent, etc., into the auxiliary tank from a container 264 holding this additive.

The above description relates to the regenerating method of the recorded material and the liquid providing means for providing the image removing accelerating liquid to the recorded material in the present invention. In the following description, the entire regenerating apparatus of the recorded material in the present invention will next be described in accordance with its concrete example with reference to FIG. 9.

The regenerating apparatus of the recorded material illustrated in FIG. 9 is constructed by five units. A paper feed unit feeds sheets of paper as a recorded material 10 by a paper feed roller 13 from an uppermost sheet. In this case, holding faces of images of the paper sheets to be removed are directed downward and these paper sheets are stacked on a paper feed tray 12. An unillustrated separating mechanism separates recorded materials from each other such that no recorded materials overlap each other. Thus, the separating mechanism feeds out only one recorded material 10 by a resist roller pair 14 for making a timing adjustment and a skew correction. Concrete construction and operation of the paper feed unit are similar to those of a paper feed mechanism in an electrophotographic copying machine, etc. Accordingly, a detailed explanation of the construction and operation of the paper feed unit is omitted here.

A providing unit of an image removing accelerating liquid as an example is constructed by two coating units using rollers shown in FIG. 4. The recorded material 10 fed from the paper feed unit is guided between a coating roller 23 and a pressing roller 24 at a first stage through a guide plate 25. An image removing accelerating liquid at the first stage is provided to this recorded material. Thereafter, the recorded material is further guided to a roller coating unit at a second stage through the guide plate 25 arranged between both the roller coating units. An image removing accelerating liquid at the second stage is provided to the recorded material in this roller coating unit. The recorded material is then conveyed to the next image removing unit. Detailed construction and operation of the coating device of these image removing accelerating liquids are already explained. Accordingly, these construction and operation are omitted here. Adhesive force between the recorded material and an image forming substance thereon is reduced by providing the image removing accelerating liquids to the recorded material by the providing unit of each of the image removing accelerating liquids.

The recorded material 10 having each of the image removing accelerating liquids provided by the providing unit is next guided to a separating unit of the image forming substance. The separating unit has a separating member belt 30, a heating roller 32 and a pressurizing roller 31. A heater 310*a* is constructed by a halogen lamp, an infrared lamp, etc. for heating the recorded material 10 and is arranged within the heating roller 32. The heating roller 32 has a heat resisting rubber layer on its surface and is made of aluminum. The pressurizing roller 31 is opposed to the heating roller 32 and pressurizes the separating member belt 30 and the recorded material 10. Similar to the heating roller 32, the pressurizing roller 31 has a heat resisting rubber layer on its surface. A heater is not necessarily arranged within the pressurizing roller 31. However, when the image forming substance is removed from the recorded material a high speed, etc., it is possible to preferably prevent a heating temperature of the recorded material from being reduced by arranging a heater 310*b*. Both the heating roller 32 and the pressurizing roller 31 have not necessarily elastic layers such as the rubber layers. For example, the heating roller 32 can be constructed by aluminum having a thin layer of a surface material such as polytetrafluoroethylene, etc. onto which no image forming substance is easily adhered. The pressurizing roller 32 is rotated by an unillustrated driving means.

The separating member belt 30 having an endless shape is supported by the pressurizing roller 31, a belt supporting roller 34, a cleaning member supporting roller 42 and a tension roller 37 and is moved. The tension roller is pressed against the separating member belt by an unillustrated biasing means such as a spring, etc. The tension roller is constructed such that tension is applied to the separating member belt.

The recorded material 10 is guided such that an image holding face of the recorded material 10 is located on a side of the separating belt 30 between the heating roller 32 and the separating belt 30. The recorded material 10 is heated and pressurized in a nipping portion formed between the heating roller 32 and the pressurizing roller 31. This heating is controlled by an unillustrated temperature detector of the rollers and a control means of a heater input such that a temperature of the image forming substance 11 on the recorded material is equal to or higher than a softening temperature of this image forming substance. It is desirable to set a rising temperature obtained by this heating in the range of a temperature equal to or higher than a softening point of the image forming substance 11 and showing that the image forming substance 11 is not completely melted and no elasticity of the image forming substance is lost. When the image forming substance 11 is completely melted and the elasticity of the image forming substance is lost, the image forming substance 11 is easily separated onto sides of the recorded material 10 and the separating belt 30 when the recorded material 10 and the separating member belt 30 are separated from each other. Therefore, the image forming substance is left on the recorded material. Further, when the image forming substance 11 is excessively heated, the image removing accelerating liquid provided to the recorded material 10 is dried when the recorded material passes through the nipping portion formed between the heating roller 32 and the pressurizing roller 31. Accordingly, adhesive force of the image forming substance 11 to the recorded material 10 is strengthened in comparison with a case in which the recorded material 10 is wet. Therefore, it is difficult to separate the recorded material 10 and the separating member belt 30 from each other. Accordingly, temperatures of the heating roller 32 and the pressurizing roller 31 are controlled and set to be lower than constant temperatures such that the image removing accelerating liquid is suitably left in the recorded material passing through the nipping portion formed between the heating roller 32 and the pressurizing roller 31 and the recorded material 10 is preferably separated from the separating member belt 30.

A pair of separating claws 36 are arranged such that the separating claws 36 come in contact with surfaces of the heating roller 32 and the separating member belt 30. After the recorded material 10 has passed through the nipping portion form ed between the heating roller 32 and the pressurizing roller 31, the image forming substance 11 is adhered to the separating member belt 30. The recorded material 10 is separated from the separating member belt 30 and the heating roller 32 by the separating claws 36.

A rotating cleaning member 40 is arranged in a position opposite to the cleaning member supporting roller 42. The image forming substance 11 transferred to the separating member of the separating member belt 30 comes in frictional contact with the cleaning member 40 so that this image forming substance 11 is removed from the separating member belt 30. It is possible to clean the separating member belt 30 by a cleaning means every separating operation. However, the separating member belt 30 may be not necessarily cleaned every separating operation. For example, the separating member belt 30 may be cleaned every suitable using number and using time. Shearing force can be applied as the cleaning member 40 to the image forming substance on the separating member. The cleaning member 40 may be constructed by any material capable of scraping off the image forming substance. In a preferable concrete example of the cleaning member 40, a roll-shaped brush member implanting hair of brass, stainless steel, etc. therein may be used. In the above description, a means for rotating the cleaning member is used as an example of the cleaning means. However, the cleaning means can be constructed by using a means for fixing a blade-shaped member made of brass, stainless steel, etc. to the separating member belt and sliding the separating member belt such that the blade-shaped member comes in press contact with the separating member belt. These cleaning means may be used independently, or some cleaning means may be combined with each other and used.

The recorded material 10 separating the image forming substance 11 therefrom is separated from the separating member belt and the heating roller. This recorded material 10 is then guided to a drying paper-discharging unit. The drying paper-discharging unit is constructed by heaters 51, a pair of recorded material conveying belts 52, etc. formed by a gas permeable material such as a cloth, a porous plastic net, etc. In the drying paper-discharging unit, excessive moisture within the recorded material 10 is evaporated and the recorded material is finished in a smooth surface state by a heating press contact from both sides of the recorded material.

A paper receiving unit has a paper discharging tray 61 for receiving the recorded material 10 discharged from the drying unit and has a paper discharging conveying guide plate 62 for guiding the recorded material to the paper discharging tray 61.

This regenerating apparatus of the recorded material also has a detecting means for detecting whether there is a recorded material 10 or not on a paper feed base, an overlapping feed detecting means of the recorded material 10 fed from the paper feed unit, a liquid amount detecting means within a liquid container 21, a jam detecting means of the recorded material 10, a lighting control means of the heaters, a full detecting means within a collecting box 41 of the image forming substance, a separating belt offset detecting means, a correcting means, etc. However, these means are not illustrated in FIG. 9.

A regenerating apparatus of the present invention having a construction different from the above apparatus construction will next be further explained.

In the regenerating apparatus of a recorded material shown in FIG. 18, a surface of the recorded material holding an image forming substance is thinly coated with a high concentration liquid 904" by a coating roller 904 and a conveying roller 904' in a first process from a paper feed tray 901 through a guide plate 903 using a paper feed roller 902. This recorded material is then guided to a separating member roller 905. A surface of the separating member roller 905 is coated with a low concentration water-soluble liquid or water 907 by a coating roller 906 in a second process. The recorded material conveyed from the above first coating roller 904 is coated and impregnated with the low concentration water-soluble liquid or water 907 through the separating member roller 905. After the recorded material is coated and impregnated with the low concentration water-soluble liquid or water 907 and the recorded material coming in contact with the separating member roller 905 comes in press contact with the heating pressurizing roller 908 and is heated by this heating pressurizing roller 908, the separating member roller 905 and the recorded material are separated from each other by a separating claw 909. The separating member roller 905 separated from the recorded material is cleaned from its surface by a toner cleaning portion 910. This surface of the separating member roller 905 is again coated with an image removing accelerating liquid. In contrast to this, the recorded material separated by the separating claw 909 has no image forming substance on its surface. Accordingly, the recorded material attains a state in which a recopy can be made and characters can be reprinted. The recorded material is guided onto a drying belt 912 by a conveying roller 911 and is dried. The dried recorded material is discharged onto a paper discharging tray 913 by a conveying roller 911 so that a recorded material able to make a recopy and reprint characters is obtained.

EMBODIMENT 1

The recorded material is regenerated by using the regenerating apparatus shown in FIG. 9.

An alkyl sulfo succinic acid-including surfactant (trade name MA-80: manufactured by MITSUI SAIANAMIDO) 1.0 weight % aqueous solution is used as the image removing accelerating liquid 20. An image is formed on a sheet of wood free paper (fine quality paper) of size A4 commercially sold by a PPC copying machine (manufactured by RICOH, trade name FT2200).

A roller coating unit is used and the image removing accelerating liquid 20 is provided to the recorded material 10. A liquid providing amount of one roller coating unit is equal to 1.1 g. Two roller coating units are arranged as shown in FIG. 5 and the same liquid is provided to the recorded material so that the liquid providing amount is equal to 2.5 g.

From this liquid providing state, separating processing of the recorded material is performed in a separating condition of linear velocity 30 mm/sec and a surface temperature 95° C. of the heating roller. Polycarbonate is used as the separating member belt.

In this separating processing, all images formed on the paper sheet are separated therefrom. No phenomenon of separation and drop of paper fibers, etc. from plain paper is seen. In the following description, this phenomenon is called paper tear.

An image is again formed on a sheet of regenerated paper and regenerative processing is again performed with respect to this paper sheet. This image formation and the regenerating operation are repeatedly performed ten times. Similar to the above case, an image is formed on this regenerated paper sheet. It is thus possible to obtain an image having a quality approximately equal to an image quality obtained when no paper sheet is used.

COMPARISON EXAMPLE 1

Only one roller coating unit shown in the Embodiment 1 is used. Similar to the Embodiment 1, the liquid provision and the separating processing are executed except that a providing amount of the image removing accelerating liquid is changed by adjusting irregularities of a roller surface and gaps between rollers. 3 g or more of the image removing accelerating liquid is required to perform preferable image separation.

No image is sufficiently separated from the paper sheet by providing 2.5 g of the image removing accelerating liquid capable of performing the image separation in the Embodiment 1. Therefore, the image is left on the paper sheet.

EMBODIMENT 2

The liquid provision and the separating processing are performed by using a regenerating apparatus of the recorded material in which the liquid providing unit of the regenerating apparatus shown in FIG. 9 is replaced with the liquid providing unit of FIG. 8. Operations similar to those in the Embodiment 1 are performed except that this liquid providing unit is used.

The liquid providing unit in this Embodiment 2 has four roller coating portions. A measured liquid providing amount of the recorded material in each of the roller coating portions ranges from 0.3 to 0.4 g. When the recorded material passes through all the four coating portions, a measured liquid providing amount of the recorded material ranges from 1.5 to 2.0 g. When the regenerative processing using this liquid providing amount is performed, all images formed on a paper sheet are separated therefrom so that no paper tear is seen.

In this Embodiment 2 and the Embodiment 1, the image removing accelerating liquid 20 is divisionally provided to the same recorded material 10 plural times. When this plural liquid provision is compared with single liquid provision, it is shown that the recorded material is preferably regenerated by a smaller providing amount of the image removing accelerating liquid. It is sufficiently effective to provide the image removing accelerating liquid to the recorded material at two stages as shown in FIG. 9. However, it has been confirmed that the providing amount of the image removing accelerating liquid can be further reduced when the image removing accelerating liquid is provided to the recorded material at three stages or more.

EMBODIMENT 3

The regenerating operation is performed by using the regenerating apparatus of FIG. 18.

An image is formed by a PPC copying machine (manufactured by RICOH, trade name IMAGIO 320 FP1) on a sheet of PPC copying paper which is not used and is not regeneratively processed in advance. An aqueous solution of 50 weight % surfactant BT-7 (manufactured by NIKKO CHEMICALS, trade name) is prepared as a high concentration liquid. In the coating roller 904 at a first stage in the regenerating apparatus of FIG. 18, about 0.4 g/size A4 of the high concentration liquid is provided to the above recorded material. Next, about 0.5 g/size A4 of water is provided by the coating roller 906 at a second stage to the recorded material having the above provided high concentration liquid. In this state, the separating member roller 905 comes in contact with an image face of the recorded material. The recorded material comes in press contact with the heating roller 908 and is heated by this heating roller 908. Thereafter, the separating member roller and the recorded material as an image holding supporting member are separated from each other by the separating claw 909. The recorded material is then guided onto the drying belt 912 by the conveying roller 911 and is dried.

An image is removed from a processed surface of the paper sheet as the recorded material. When this processed paper sheet is reused in the above copying machine, a clear image can be obtained on this paper sheet.

The image formation and the regenerating operation are repeatedly performed ten times. Similar to the above case, an image is formed on this regenerated paper sheet. It is thus possible to obtain an image having a quality approximately equal to an image quality obtained when no paper sheet is used.

COMPARISON EXAMPLE 2

No liquid is provided to a paper sheet having an image obtained as in the Embodiment 3 by the coating roller 904 at the first stage in the regenerating apparatus of FIG. 18. In this example, a 1 weight % BT-7 surfactant aqueous solution is directly provided to the paper sheet by the coating roller 906 at the second stage such that a providing amount of this aqueous solution is equal to 0.5 g/size A4. Thereafter, in this state, the separating member roller 905 comes in contact with an image face of the recorded material. The recorded material is then heated and pressurized by the heating pressurizing roller 908. Thereafter, when the separating member roller and the recorded material are separated from each other by the separating claw 909, no image is almost separated from the recorded material and a surface portion of the paper sheet as the recorded material is damaged and broken.

COMPARISON EXAMPLE 3

No liquid is provided to a paper sheet having an image obtained as in the Embodiment 3 by the coating roller 904 at the first stage in the regenerating apparatus of FIG. 18. In this example, a 1 weight % BT-7 surfactant aqueous solution is directly provided to the paper sheet by the coating roller 906 at the second stage. The providing amount of the image removing accelerating liquid is changed by adjusting irregularities of a surface of the coating roller 906 at the second stage and gaps between rollers. The recorded material having this providing amount of the image removing accelerating liquid is prepared. Similar to the Embodiment 3, an image face of the recorded material comes in contact with the separating member roller 905. The recorded material then comes in press contact with the heating roller 908 and is heated by this heating roller 908. Thereafter, the recorded material as an image holding supporting member is separated from the separating member roller by the separating claw 909.

It is necessary to provide about 3 g or more/size A4 of the image removing accelerating liquid to the recorded material so as to preferably separate an image from the recorded material.

The image can be separated from the recorded material by providing 3 g or more/size A4 of the image removing accelerating liquid to the recorded material. However, in the same drying condition as the Embodiment 3, the discharged paper sheet as the recorded material is still wet. Accordingly, it has been clearly confirmed that large energy is required to dry the paper sheet in comparison with the providing amount of the image removing accelerating liquid in the Embodiment 3.

EMBODIMENT 4

An aqueous solution of surfactant BT-7 at the first stage in the Embodiment 3 is replaced with an ethanol solution. Further, water at the second stage is replaced with an aqueous solution of starch as a 1 weight % water-soluble polymer. A regenerating operation is similar to that in the Embodiment 3 except for these replacements.

As a result, after the recorded material comes in press contact with the separating member roller 908 and is heated by this separating member roller 908, the recorded material is separated from the separating member by the separating claw 909. There is no image on a surface of the recorded material. The paper sheet as the recorded material is guided to the drying belt 912 by the conveying roller 911. The paper sheet discharged through a drying process has been dried. When the discharged paper sheet having no image is reused by the above copying machine, it is possible to obtain a sheet of copying paper having a clear image.

The image formation and the regenerating operation are repeatedly performed ten times by similar operations. Thereafter, similar to the above case, an image is formed on the paper sheet. It is thus possible to obtain an image having a quality approximately equal to an image quality obtained when no paper sheet is used.

COMPARISON EXAMPLE 4

No liquid is provided to a paper sheet having an image obtained as in the Embodiment 4 by the coating roller 904 at the first stage in the regenerating apparatus of FIG. 18. In this example, 0.5 g/size A4 of mixing liquid is directly provided to the paper sheet by the coating roller 906 at the second stage. In this mixing liquid, an amount of a starch aqueous solution as a 1 weight % water-soluble polymer is equal to that of an aqueous solution of 1 weight % surfactant BT-7. In this state, an image face of the recorded material comes in contact with the separating member roller 905. The recorded material is then heated and pressurized by the heating pressurizing roller 908. Thereafter, when the recorded material is separated from the separating member roller by the separating claw 909, no image is almost separated from the recorded material and a surface portion of the paper sheet as the recorded material is damaged and broken.

COMPARISON EXAMPLE 5

No liquid is provided to a paper sheet having an image obtained as in the Embodiment 4 by the coating roller 904 at the first stage in the regenerating apparatus of FIG. 18. In this example, a mixing liquid is directly provided to the paper sheet by the coating roller 906 at the second stage. In this mixing liquid, an amount of a starch aqueous solution as a 1 weight % water-soluble polymer is equal to that of an aqueous solution of 1 weight % surfactant BT-7.The providing amount of the image removing accelerating liquid is changed by adjusting irregularities of a surface of the coating roller 906 at the second stage and gaps between rollers. The recorded material having this providing amount of the image removing accelerating liquid is prepared. Similar to the Embodiment 4, an image face of the recorded material comes in contact with the separating member roller 905. The recorded material then comes in press contact with the heating roller 908 and is heated by this heating roller 908. Thereafter, the recorded material as an image holding supporting member is separated from the separating member roller by the separating claw 909.

It is necessary to provide about 3 g or more/size A4 of the image removing accelerating liquid to the recorded material so as to preferably separate an image from the recorded material.

The image can be separated from the recorded material by providing 3 g or more/size A4 of the image removing accelerating liquid to the recorded material. However, in the same drying condition as the Embodiment 4, the discharged paper sheet as the recorded material is still wet. Accordingly, it has been clearly confirmed that large energy is required to dry the paper sheet in comparison with the providing amount of the image removing accelerating liquid in the Embodiment 4.

EMBODIMENT 5

An aqueous solution of 0.02 weight % surfactant BT-7 is used instead of water at the second stage in the Embodiment 3. The regenerating operation is similar to that in the Embodiment 3 except for this usage. In this embodiment, about 0.5 g/size A4 of the image removing accelerating liquid at the second stage is provided to the recorded material.

As a result, after the recorded material comes in press contact with the separating member roller 908 and is heated by this separating member roller 908, the recorded material is separated from the separating member by the separating claw 909. There is no image on a surface of the recorded material. The paper sheet as the recorded material is guided to the drying belt 912 by the conveying roller 911. The paper sheet discharged through a drying process has been dried. When the discharged paper sheet having no image is reused by the above copying machine, it is possible to obtain a sheet of copying paper having a clear image.

The image formation and the regenerating operation are repeatedly performed ten times by similar operations. Thereafter, similar to the above case, an image is formed on the paper sheet. It is thus possible to obtain an image having a quality approximately equal to an image quality obtained when no paper sheet is used.

COMPARISON EXAMPLE 6

No liquid is provided to a paper sheet having an image obtained as in the Embodiment 5 by the coating roller 904 at the first stage in the regenerating apparatus of FIG. 18. In this example, an aqueous solution of 0.02 weight % surfactant BT-7 is directly provided to the paper sheet by the coating roller 906 at the second stage such that a providing amount of this aqueous solution is equal to 0.5 g/size A4. In this state, the separating member roller 905 comes in contact with an image face of the recorded material. The recorded material is then heated and pressurized by the heating pressurizing roller 908. Thereafter, when the separating member roller and the recorded material are separated from each other by the separating claw 909, no image is almost separated from the recorded material and a surface portion of the paper sheet as the recorded material is damaged and broken.

EMBODIMENT 6

An ethanol solution of BT-12 (manufactured by NIKKO CHEMICALS, trade name) is used instead of the surfactant BT-7 aqueous solution at the first stage in the Embodiment 3. The regenerating operation is similar to that in the Embodiment 3 except for this usage. At this time, the providing amount of the image removing accelerating liquid at the first stage is equal to about 0.05 g/size A4. The providing amount of the image removing accelerating liquid at the second stage is equal to about 0.5 g/size A4.

As a result, after the recorded material comes in press contact with the separating member roller 908 and is heated by this separating member roller 908, the recorded material is separated from the separating member by the separating claw 909. There is no image on a surface of the recorded material. The paper sheet as the recorded material is guided to the drying belt 912 by the conveying roller 911. The paper sheet discharged through a drying process has been dried. When the discharged paper sheet having no image is reused by the above copying machine, it is possible to obtain a sheet of copying paper having a clear image.

The image formation and the regenerating operation are repeatedly performed ten times by similar operations. Thereafter, similar to the above case, an image is formed on the paper sheet. It is thus possible to obtain an image having a quality approximately equal to an image quality obtained when no paper sheet is used.

COMPARISON EXAMPLE 7

No liquid is provided to a paper sheet having an image obtained as in the Embodiment 6 by the coating roller 904 at the first stage in the regenerating apparatus of FIG. 18. In this example, an aqueous solution of 1 weight % surfactant BT-7 is directly provided to the paper sheet by the coating roller 906 at the second stage such that a providing amount of this aqueous solution is equal to about 0.5 g/size A4. In this state, the separating member roller 905 comes in contact with an image face of the recorded material. The recorded material is then heated and pressurized by the heating pressurizing roller 908. Thereafter, when the separating member roller and the recorded material are separated from each other by the separating claw 909, no image is almost separated from the recorded material and a surface portion of the paper sheet as the recorded material is damaged and broken.

COMPARISON EXAMPLE 8

No liquid is provided to a paper sheet having an image obtained as in the Embodiment 6 by the coating roller 904 at the first stage in the regenerating apparatus of FIG. 18. In this example, an aqueous solution of 1 weight % surfactant BT-7 is directly provided to the paper sheet by the coating roller 906 at the second stage. The providing amount of the image removing accelerating liquid is changed by adjusting irregularities of a surface of the coating roller 906 at the second stage and gaps between rollers. The recorded material having this providing amount of the image removing accelerating liquid is prepared. Similar to the Embodiment 6, an image face of the recorded material comes in contact with the separating member roller 905. The recorded material then comes in press contact with the heating roller 908 and is heated by this heating roller 908. Thereafter, the recorded material as an image holding supporting member is separated from the separating member roller by the separating claw 909.

It is necessary to provide about 3 g or more/size A4 of the image removing accelerating liquid to the recorded material so as to preferably separate an image from the recorded material.

The image can be separated from the recorded material by providing 3 g or more/size A4 of the image removing accelerating liquid to the recorded material. However, in the same drying condition as the Embodiment 3, the discharged paper sheet as the recorded material is still wet. Accordingly, it has been clearly confirmed that large energy is required to dry the paper sheet in comparison with the providing amount of the image removing accelerating liquid in the Embodiment 4.

EMBODIMENT 7

An aqueous solution of BT-12 is used instead of the surfactant BT-7 ethanol solution at the first stage in the Embodiment 4. The regenerating operation is similar to that in the Embodiment 4 except for this usage. At this time, the providing amount of the image removing accelerating liquid at the first stage is equal to about 0.05 g/size A4. The providing amount of the image removing accelerating liquid at the second stage is equal to about 0.5 g/size A4.

As a result, after the recorded material comes in press contact with the separating member roller 908 and is heated by this separating member roller 908, the recorded material is separated from the separating member by the separating claw 909. There is no image on a surface of the recorded material. The paper sheet as the recorded material is guided to the drying belt 912 by the conveying roller 911. The paper sheet discharged through a drying process has been dried. When the discharged paper sheet having no image is reused by the above copying machine, it is possible to obtain a sheet of copying paper having a clear image.

The image formation and the regenerating operation are repeatedly performed ten times by similar operations. Thereafter, similar to the above case, an image is formed on the paper sheet. It is thus possible to obtain an image having a quality approximately equal to an image quality obtained when no paper sheet is used.

COMPARISON EXAMPLE 9

No liquid is provided to a paper sheet having an image obtained as in the Embodiment 7 by the coating roller 904 at the first stage in the regenerating apparatus of FIG. 18. In this example, an aqueous solution of 1 weight % surfactant BT-12 is directly provided to the paper sheet by the coating roller 906 at the second stage such that a providing amount of this aqueous solution is equal to about 0.5 g/size A4. In this state, the separating member roller 905 comes in contact with an image face of the recorded material. The recorded material is then heated and pressurized by the heating pressurizing roller 908. Thereafter, when the separating member roller and the recorded material are separated from each other by the separating claw 909, no image is almost separated from the recorded material and a surface portion of the paper sheet as the recorded material is damaged and broken.

COMPARISON EXAMPLE 10

No liquid is provided to a paper sheet having an image obtained as in the Embodiment 7 by the coating roller 904 at the first stage in the regenerating apparatus of FIG. 18. In this example, an aqueous solution of 1 weight % surfactant BT-12 is directly provided to the paper sheet by the coating roller 906 at the second stage. The providing amount of the image removing accelerating liquid is changed by adjusting irregularities of a surface of the coating roller 906 at the second stage and gaps between rollers. The recorded material having this providing amount of the image removing accelerating liquid is prepared. Similar to the Embodiment 7, an image face of the recorded material comes in contact with the separating member roller 905. The recorded material then comes in press contact with the heating roller 908 and is heated by this heating roller 908. Thereafter, the recorded material as an image holding supporting member is separated from the separating member roller by the separating claw 909.

It is necessary to provide about 3 g or more/size A4 of the image removing accelerating liquid to the recorded material so as to preferably separate an image from the recorded material.

The image can be separated from the recorded material by providing 3 g or more/size A4 of the image removing accelerating liquid to the recorded material. However, in the same drying condition as the Embodiment 3, the discharged paper sheet as the recorded material is still wet. Accordingly, it has been clearly confirmed that large energy is required to dry the paper sheet in comparison with the providing amount of the image removing accelerating liquid in the Embodiment 4.

EMBODIMENT 8

BT-12 is used instead of the surfactant BT-7 at the first stage in the Embodiment 5. The regenerating operation is similar to that in the Embodiment 5 except for this usage. At this time, the providing amount of the image removing accelerating liquid at the first stage is equal to about 0.05 g/size A4. The providing amount of the image removing accelerating liquid at the second stage is equal to about 0.5 g/size A4.

As a result, after the recorded material comes in press contact with the separating member roller 908 and is heated by this separating member roller 908, the recorded material is separated from the separating member by the separating claw 909. There is no image on a surface of the recorded material. The paper sheet as the recorded material is guided to the drying belt 912 by the conveying roller 911. The paper sheet discharged through a drying process has been dried. When the discharged paper sheet having no image is reused by the above copying machine, it is possible to obtain a sheet of copying paper having a clear image.

The image formation and the regenerating operation are repeatedly performed ten times by similar operations. Thereafter, similar to the above case, an image is formed on the paper sheet. It is thus possible to obtain an image having a quality approximately equal to an image quality obtained when no paper sheet is used.

COMPARISON EXAMPLE 11

No liquid is provided to a paper sheet having an image obtained as in the Embodiment 8 by the coating roller 904 at the first stage in the regenerating apparatus of FIG. 18. In this example, an aqueous solution of 0.02 weight % surfactant BT-12 is directly provided to the paper sheet by the coating roller 906 at the second stage such that a providing amount of this aqueous solution is equal to about 0.5 g/size A4. In this state, the separating member roller 905 comes in contact with an image face of the recorded material. The recorded material is then heated and pressurized by the heating pressurizing roller 908. Thereafter, when the separating member roller and the recorded material are separated from each other by the separating claw 909, no image is almost separated from the recorded material and a surface portion of the paper sheet as the recorded material is damaged and broken.

EMBODIMENT 9

Surfactant MA-80 (manufactured by MITSUI SAIANAMIDO, trade name) is used instead of surfactant BT-7 at the first stage in the Embodiment 3. The regenerating operation is similar to that in the Embodiment 3 except for this usage. At this time, the providing amount of the image removing accelerating liquid at the first stage is equal to about 0.08 g/size A4. The providing amount of the image removing accelerating liquid at the second stage is equal to about 0.5 g/size A4.

As a result, after the recorded material comes in press contact with the separating member roller 908 and is heated by this separating member roller 908, the recorded material is separated from the separating member by the separating claw 909. There is no image on a surface of the recorded material. The paper sheet as the recorded material is guided to the drying belt 912 by the conveying roller 911. The paper sheet discharged through a drying process has been dried. When the discharged paper sheet having no image is reused by the above copying machine, it is possible to obtain a sheet of copying paper having a clear image.

The image formation and the regenerating operation are repeatedly performed ten times by similar operations. Thereafter, similar to the above case, an image is formed on the paper sheet. It is thus possible to obtain an image having a quality approximately equal to an image quality obtained when no paper sheet is used.

COMPARISON EXAMPLE 12

No liquid is provided to a paper sheet having an image obtained as in the Embodiment 8 by the coating roller 904 at the first stage in the regenerating apparatus of FIG. 18. In this example, an aqueous solution of 0.2 weight % surfactant MA-80 is directly provided to the paper sheet by the coating roller 906 at the second stage such that a providing amount of this aqueous solution is equal to 0.6 g/size A4. In this state, the separating member roller 905 comes in contact with an image face of the recorded material. The recorded material is then heated and pressurized by the heating pressurizing roller 908. Thereafter, when the separating member roller an d the recorded material are separated from each other by the separating claw 909, no image is almost separated from the recorded material and a surface portion of the paper sheet as the recorded material is damaged and broken.

COMPARISON EXAMPLE 13

No liquid is provided to a paper sheet having an image obtained as in the Embodiment 9 by the coating roller 904 at the first stage in the regenerating apparatus of FIG. 18. In this example, an aqueous solution of 0.2 weight % MA-80 is directly provided to the paper sheet by the coating roller 906 at the second stage. The providing amount of the image removing accelerating liquid is changed by adjusting irregularities of a surface of the coating roller 906 at the second stage and gaps between rollers. The recorded material having this providing amount of the image removing accelerating liquid is prepared. Similar to the Embodiment 9, an image face of the recorded material comes in contact with the separating member roller 905. The recorded material then comes in press contact with the heating roller 908 and is heated by this heating roller 908. Thereafter, the recorded material as an image holding supporting member is separated from the separating member roller by the separating claw 909.

It is necessary to provide about 3 g or more/size A4 of the image removing accelerating liquid to the recorded material so as to preferably separate an image from the recorded material.

The image can be separated from the recorded material by providing 3 g or more/size A4 of the image removing accelerating liquid to the recorded material. However, in the same drying condition as the Embodiment 4, the discharged paper sheet as the recorded material is still wet. Accordingly, it has been clearly confirmed that large energy is required to dry the paper sheet in comparison with the providing amount of the image removing accelerating liquid in the Embodiment 4.

EMBODIMENT 10

An aqueous solution of 50 weight % surfactant MA-80 is used instead of an ethanol aqueous solution of surfactant BT-7 at the first stage in the Embodiment 4. The regenerating operation is similar to that in the Embodiment 4 except for this usage. At this time, the providing amount of the image removing accelerating liquid at the first stage is equal to about 0.10 g/size A4. The providing amount of the image removing accelerating liquid at the second stage is equal to about 0.5 g/size A4.

As a result, after the recorded material comes in press contact with the separating member roller 908 and is heated by this separating member roller 908, the recorded material is separated from the separating member by the separating claw 909. There is no image on a surface of the recorded material. The paper sheet as the recorded material is guided to the drying belt 912 by the conveying roller 911. The paper sheet discharged through a drying process has been dried. When the discharged paper sheet having no image is reused by the above copying machine, it is possible to obtain a sheet of copying paper having a clear image.

The image formation and the regenerating operation are repeatedly performed ten times by similar operations. Thereafter, similar to the above case, an image is formed on the paper sheet. It is thus possible to obtain an image having a quality approximately equal to an image quality obtained when no paper sheet is used.

COMPARISON EXAMPLE 14

No liquid is provided to a paper sheet having an image obtained as in the Embodiment 10 by the coating roller 904 at the first stage in the regenerating apparatus of FIG. 18. In this example, a mixing solution is directly provided to the paper sheet by the coating roller 906 at the second stage such that a providing amount of this mixing solution is equal to 0.5 g/size A4. In this mixing solution, an amount of a starch aqueous solution as a 1 weight % water-soluble polymer is equal to that of an aqueous solution of 1 weight % surfactant MA-80.In this state, the separating member roller 905 comes in contact with an image face of the recorded material. The recorded material is then heated and pressurized by the heating pressurizing roller 908. Thereafter, when the separating member roller and the recorded material are separated from each other by the separating claw 909, no image is almost separated from the recorded material and a surface portion of the paper sheet as the recorded material is damaged and broken.

COMPARISON EXAMPLE 15

No liquid is provided to a paper sheet having an image obtained as in the Embodiment 10 by the coating roller 904 at the first stage in the regenerating apparatus of FIG. 18. In this example, a mixing solution is directly provided to the paper sheet by the coating roller 906 at the second stage. In this mixing solution, an amount of a starch aqueous solution as a 1 weight % water-soluble polymer is equal to that of an aqueous solution of 1 weight % surfactant MA-80. The providing amount of the image removing accelerating liquid is changed by adjusting irregularities of a surface of the coating roller 906 at the second stage and gaps between rollers. The recorded material having this providing amount of the image removing accelerating liquid is prepared. Similar to the Embodiment 6, an image face of the recorded material comes in contact with the separating member roller 905. The recorded material then comes in press contact with the heating roller 908 and is heated by this heating roller 908. Thereafter, the recorded material as an image holding supporting member is separated from the separating member roller by the separating claw 909.

It is necessary to provide about 3 g or more/size A4 of the image removing accelerating liquid to the recorded material so as to preferably separate an image from the recorded material The image can be separated from the recorded material by providing 3 g or more/size A4 of the image removing accelerating liquid to the recorded material. However, in the same drying condition as the Embodiment 3, the discharged paper sheet as the recorded material is still wet. Accordingly, it has been clearly confirmed that large energy is required to dry the paper sheet in comparison with the providing amount of the image removing accelerating liquid in the Embodiment 4.

EMBODIMENT 11

An ethanol solution is used instead of the 50 weight % surfactant MA-80 aqueous solution at the first stage in the Embodiment 9. Further, a 0.2 weight % surfactant MA-80 aqueous solution is used instead of water at the next stage. The regenerating operation is similar to that in the Embodiment 9 except for these usages. At this time, the providing amount of the image removing accelerating liquid at the first stage is equal to about 0.15 g/size A4. The providing amount of the image removing accelerating liquid at the second stage is equal to about 0.5 g/size A4.

As a result, after the recorded material comes in press contact with the separating member roller 908 and is heated by this separating member roller 908, the recorded material is separated from the separating member by the separating claw 909. There is no image on a surface of the recorded material. The paper sheet as the recorded material is guided to the drying belt 912 by the conveying roller 911. The paper sheet discharged through a drying process has been dried. When the discharged paper sheet having no image is reused by the above copying machine, it is possible to obtain a sheet of copying paper having a clear image.

The image formation and the regenerating operation are repeatedly performed ten times by similar operations. Thereafter, similar to the above case, an image is formed on the paper sheet. It is thus possible to obtain an image having a quality approximately equal to an image quality obtained when no paper sheet is used.

EMBODIMENT 12

Surfactant RBS-25 (manufactured by JYNSEI KAGAKU, trade name) is used instead of surfactant BT-7 at the first stage in the Embodiment 3. The regenerating operation is similar to that in the Embodiment 3 except for this usage. At this time, the providing amount of the image removing accelerating liquid at the first stage is equal to about 0.3 g/size A4. The providing amount of the image removing accelerating liquid at the second stage is equal to about 0.5 g/size A4.

As a result, after the recorded material comes in press contact with the separating member roller 908 and is heated by this separating member roller 908, the recorded material is separated from the separating member by the separating claw 909. There is no image on a surface of the recorded material. The paper sheet as the recorded material is guided to the drying belt 912 by the conveying roller 911. The paper sheet discharged through a drying process has been dried. When the discharged paper sheet having no image is reused by the above copying machine, it is possible to obtain a sheet of copying paper having a clear image.

The image formation and the regenerating operation are repeatedly performed ten times by similar operations. Thereafter, similar to the above case, an image is formed on the paper sheet. It is thus possible to obtain an image having a quality approximately equal to an image quality obtained when no paper sheet is used.

EMBODIMENT 13

Surfactant RBS-25 (manufactured by JYNSEI KAGAKU, trade name) is used instead of surfactant BT-7 at the first stage in the Embodiment 4. The regenerating operation is similar to that in the Embodiment 4 except for this usage. At this time, the providing amount of the image removing accelerating liquid at the first stage is equal to about 0.3 g/size A4. The providing amount of the image removing accelerating liquid at the second stage is equal to about 0.5 g/size A4.

As a result, after the recorded material comes in press contact with the separating member roller 908 and is heated by this separating member roller 908, the recorded material is separated from the separating member by the separating claw 909. There is no image on a surface of the recorded material. The paper sheet as the recorded material is guided to the drying belt 912 by the conveying roller 911. The paper sheet discharged through a drying process has been dried. When the discharged paper sheet having no image is reused by the above copying machine, it is possible to obtain a sheet of copying paper having a clear image.

The image formation and the regenerating operation are repeatedly performed ten times by similar operations. Thereafter, similar to the above case, an image is formed on the paper sheet. It is thus possible to obtain an image having a quality approximately equal to an image quality obtained when no paper sheet is used.

EMBODIMENT 14

A 20 weight % surfactant BT-7 aqueous solution is used instead of the 50 weight % surfactant BT-7 aqueous solution at the first stage in the Embodiment 3. The regenerating operation is similar to that in the Embodiment 3 except for this usage. At this time, the providing amount of the image removing accelerating liquid at the first stage is equal to about 0.06 g/size A4. The providing amount of the image removing accelerating liquid at the second stage is equal to about 0.5 g/size A4.

As a result, after the recorded material comes in press contact with the separating member roller 908 and is heated by this separating member roller 908, the recorded material is separated from the separating member by the separating claw 909. There is no image on a surface of the recorded material. The paper sheet as the recorded material is guided to the drying belt 912 by the conveying roller 911. The paper sheet discharged through a drying process has been dried. When the discharged paper sheet having no image is reused by the above copying machine, it is possible to obtain a sheet of copying paper having a clear image.

The image formation and the regenerating operation are repeatedly performed ten times by similar operations. Thereafter, similar to the above case, an image is formed on the paper sheet. It is thus possible to obtain an image having a quality approximately equal to an image quality obtained when no paper sheet is used.

EMBODIMENT 15

A 20 weight % surfactant BT-7 aqueous solution is used instead of the 50 weight % surfactant BT-7 ethanol solution at the first stage in the Embodiment 4. The regenerating operation is similar to that in the Embodiment 4 except for this usage. At this time, the providing amount of the image removing accelerating liquid at the first stage is equal to about 0.05 g/size A4. The providing amount of the image removing accelerating liquid at the second stage is equal to about 0.7 g/size A4.

As a result, after the recorded material comes in press contact with the separating member roller 908 and is heated by this separating member roller 908, the recorded material is separated from the separating member by the separating claw 909. There is no image on a surface of the recorded material. The paper sheet as the recorded material is guided to the drying belt 912 by the conveying roller 911. The paper sheet discharged through a drying process has been dried. When the discharged paper sheet having no image is reused by the above copying machine, it is possible to obtain a sheet of copying paper having a clear image.

The image formation and the regenerating operation are repeatedly performed ten times by similar operations. Thereafter, similar to the above case, an image is formed on the paper sheet. It is thus possible to obtain an image having a quality approximately equal to an image quality obtained when no paper sheet is used.

EMBODIMENT 16

A 20 weight % surfactant BT-12 aqueous solution is used instead of the 50 weight % surfactant BT-7 aqueous solution at the first stage in the Embodiment 3. The regenerating operation is similar to that in the Embodiment 3 except for this usage. At this time, the providing amount of the image removing accelerating liquid at the first stage is equal to about 0.06 g/size A4. The providing amount of the image removing accelerating liquid at the second stage is equal to about 0.7 g/size A4.

As a result, after the recorded material comes in press contact with the separating member roller 908 and is heated by this separating member roller 908, the recorded material is separated from the separating member by the separating claw 909. There is no image on a surface of the recorded material. The paper sheet as the recorded material is guided to the drying belt 912 by the conveying roller 911. The paper sheet discharged through a drying process has been dried. When the discharged paper sheet having no image is reused by the above copying machine, it is possible to obtain a sheet of copying paper having a clear image.

The image formation and the regenerating operation are repeatedly performed ten times by similar operations. Thereafter, similar to the above case, an image is formed on the paper sheet. It is thus possible to obtain an image having a quality approximately equal to an image quality obtained when no paper sheet is used.

EMBODIMENT 17

A 20 weight % surfactant BT-12 aqueous solution is used instead of the 50 weight % surfactant BT-7 ethanol solution at the first stage in the Embodiment 4. The regenerating operation is similar to that in the Embodiment 4 except for this usage. At this time, the providing amount of the image removing accelerating liquid at the first stage is equal to about 0.06 g/size A4. The providing amount of the image removing accelerating liquid at the second stage is equal to about 0.7 g/size A4.

As a result, after the recorded material comes in press contact with the separating member roller 908 and is heated by this separating member roller 908, the recorded material is separated from the separating member by the separating claw 909. There is no image on a surface of the recorded material. The paper sheet as the recorded material is guided to the drying belt 912 by the conveying roller 911. The paper sheet discharged through a drying process has been dried. When the discharged paper sheet having no image is reused by the above copying machine, it is possible to obtain a sheet of copying paper having a clear image.

The image formation and the regenerating operation are repeatedly performed ten times by similar operations.

Thereafter, similar to the above case, an image is formed on the paper sheet. It is thus possible to obtain an image having a quality approximately equal to an image quality obtained when no paper sheet is used.

EMBODIMENT 18

A 20 weight % surfactant MA-80 aqueous solution is used instead of the 50 weight % surfactant BT-7 aqueous solution at the first stage in the Embodiment 3. The regenerating operation is similar to that in the Embodiment 3 except for this usage. At this time, the providing amount of the image removing accelerating liquid at the first stage is equal to about 0.03 g/size A4. The providing amount of the image removing accelerating liquid at the second stage is equal to about 0.6 g/size A4.

As a result, after the recorded material comes in press contact with the separating member roller 908 and is heated by this separating member roller 908, the recorded material is separated from the separating member by the separating claw 909. There is no image on a surface of the recorded material. The paper sheet as the recorded material is guided to the drying belt 912 by the conveying roller 911. The paper sheet discharged through a drying process has been dried, When the discharged paper sheet having no image is reused by the above copying machine, it is possible to obtain a sheet of copying paper having a clear image.

The image formation and the regenerating operation are repeatedly performed ten times by similar operations. Thereafter, similar to the above case, an image is formed on the paper sheet. It is thus possible to obtain an image having a quality approximately equal to an image quality obtained when no paper sheet is used.

EMBODIMENT 19

A 20 weight % surfactant MA-80 aqueous solution is used instead of the 50 weight % surfactant BT-7 ethanol solution at the first stage in the Embodiment 4. The regenerating operation is similar to that in the Embodiment 4 except for this usage. At this time, the providing amount of the image removing accelerating liquid at the first stage is equal to about 0.03 g/size A4. The providing amount of the image removing accelerating liquid at the second stage is equal to about 0.6 g/size A4.

As a result, after the recorded material comes in press contact with the separating member roller 908 and is heated by this separating member roller 908, the recorded material is separated from the separating member by the separating claw 909. There is no image on a surface of the recorded material. The paper sheet as the recorded material is guided to the drying belt 912 by the conveying roller 911. The paper sheet discharged through a drying process has been dried. When the discharged paper sheet having no image is reused by the above copying machine, it is possible to obtain a sheet of copying paper having a clear image.

The image formation and the regenerating operation are repeatedly performed ten times by similar operations. Thereafter, similar to the above case, an image is formed on the paper sheet. It is thus possible to obtain an image having a quality approximately equal to an image quality obtained when no paper sheet is used.

EMBODIMENT 20

A 20 weight % surfactant RBS-25 aqueous solution is used instead of the 50 weight % surfactant BT-7 aqueous solution at the first stage in the Embodiment 3. The regenerating operation is similar to that in the Embodiment 3 except for this usage. At this time, the providing amount of the image removing accelerating liquid at the first stage is equal to about 0.08 g/size A4. The providing amount of the image removing accelerating liquid at the second stage is equal to about 1.0 g/size A4.

As a result, after the recorded material comes in press contact with the separating member roller 908 and is heated by this separating member roller 908, the recorded material is separated from the separating member by the separating claw 909. There is no image on a surface of the recorded material. The paper sheet as the recorded material is guided to the drying belt 912 by the conveying roller 911. The paper sheet discharged through a drying process has been dried. When the discharged paper sheet having no image is reused by the above copying machine, it is possible to obtain a sheet of copying paper having a clear image.

The image formation and the regenerating operation are repeatedly performed ten times by similar operations. Thereafter, similar to the above case, an image is formed on the paper sheet. It is thus possible to obtain an image having a quality approximately equal to an image quality obtained when no paper sheet is used.

EMBODIMENT 21

A 20 weight % surfactant RBS-25 aqueous solution is used instead of the 50 weight % surfactant BT-7 ethanol solution at the first stage in the Embodiment 4. The regenerating operation is similar to that in the Embodiment 4 except for this usage. At this time, the providing amount of the image removing accelerating liquid at the first stage is equal to about 0.08 g/size A4. The providing amount of the image removing accelerating liquid at the second stage is equal to about 1.2 g/size A4.

As a result, after the recorded material comes in press contact with the separating member roller 908 and is heated by this separating member roller 908, the recorded material is separated from the separating member by the separating claw 909. There is no image on a surface of the recorded material. The paper sheet as the recorded material is guided to the drying belt 912 by the conveying roller 911. The paper sheet discharged through a drying process has been dried. When the discharged paper sheet having no image is reused by the above copying machine, it is possible to obtain a sheet of copying paper having a clear image.

The image formation and the regenerating operation are repeatedly performed ten times by similar operations. Thereafter, similar to the above case, an image is formed on the paper sheet. It is thus possible to obtain an image having a quality approximately equal to an image quality obtained when no paper sheet is used.

EMBODIMENT 22

An aqueous solution of 20 weight % surfactant SH3746 (manufactured by TOHRE DAUCONING, trade name) is used instead of the 50 weight % surfactant BT-7 aqueous solution at the first stage in the Embodiment 3. The regenerating operation is similar to that in the Embodiment 3 except for this usage. At this time, the providing amount of the image removing accelerating liquid at the first stage is equal to about 0.05 g/size A4. The providing amount of the image removing accelerating liquid at the second stage is equal to about 0.7 g/size A4.

As a result, after the recorded material comes in press contact with the separating member roller 908 and is heated by this separating member roller 908, the recorded material is s separated from the separating member by the separating claw 909. There is no image on a surface of the recorded material. The paper sheet as the recorded material is guided to the drying belt 912 by the conveying roller 911. The paper sheet discharged through a drying process has been dried. When the discharged paper sheet having no image is reused by the above copying machine, it is possible to obtain a sheet of copying paper having a clear image.

The image formation and the regenerating operation are repeatedly performed ten times by similar operations. Thereafter, similar to the above case, an image is formed on the paper sheet. It is thus possible to obtain an image having a quality approximately equal to an image quality obtained when no paper sheet is used.

EMBODIMENT 23

An aqueous solution of 20 weight % surfactant TSF4771 (manufactured by TOSHIBA SILICON, trade name) is used instead of the 50 weight % surfactant BT-7 ethanol solution at the first stage in the Embodiment 4. The regenerating operation is similar to that in the Embodiment 4 except for this usage. At this time, the providing amount of the image removing accelerating liquid at the first stage is equal to about 0.05 g/size A4. The providing amount of the image removing accelerating liquid at the second stage is equal to about 0.7 g/size A4.

As a result, after the recorded material comes in press contact with the separating member roller 908 and is heated by this separating member roller 908, the recorded material is separated from the separating member by the separating claw 909. There is no image on a surface of the recorded material. The paper sheet as the recorded material is guided to the drying belt 912 by the conveying roller 911. The paper sheet discharged through a drying process has been dried. When the discharged paper sheet having no image is reused by the above copying machine, it is possible to obtain a sheet of copying paper having a clear image.

The image formation and the regenerating operation are repeatedly performed ten times by similar operations. Thereafter, similar to the above case, an image is formed on the paper sheet. It is thus possible to obtain an image having a quality approximately equal to an image quality obtained when no paper sheet is used.

EMBODIMENT 24

100 weight % surfactant SH3746 is used instead of the 50 weight % surfactant BT-7 aqueous solution at the first stage in the Embodiment 3. The regenerating operation is similar to that in the Embodiment 3 except for this usage. At this time, the providing amount of the image removing accelerating liquid at the first stage is equal to about 0.06 g/size A4. The providing amount of the image removing accelerating liquid at the second stage is equal to about 0.8 g/size A4.

As a result, after the recorded material comes in press contact with the separating member roller 908 and is heated by this separating member roller 908, the recorded material is separated from the separating member by the separating claw 909. There is no image on a surface of the recorded material. The paper sheet as the recorded material is guided to the drying belt 912 by the conveying roller 911. The paper sheet discharged through a drying process has been dried. When the discharged paper sheet having no image is reused by the above copying machine, it is possible to obtain a sheet of copying paper having a clear image.

The image formation and the regenerating operation are repeatedly performed ten times by similar operations. Thereafter, similar to the above case, an image is formed on the paper sheet. It is thus possible to obtain an image having a quality approximately equal to an image quality obtained when no paper sheet is used.

EMBODIMENT 25

100 weight % surfactant TSF4771 is used instead of the 50 weight % surfactant BT-7 ethanol solution at the first stage in the Embodiment 4. The regenerating operation is similar to that in the Embodiment 4 except for this usage. At this time, the providing amount of the image removing accelerating liquid at the first stage is equal to about 0.25 g/size A4. The providing amount of the image removing accelerating liquid at the second stage is equal to about 0.5 g/size A4.

As a result, after the recorded material comes in press contact with the separating member roller 908 and is heated by this separating member roller 908, the recorded material is separated from the separating member by the separating claw 909. There is no image on a surface of the recorded material. The paper sheet as the recorded material is guided to the drying belt 912 by the conveying roller 911. The paper sheet discharged through a drying process has been dried. When the discharged paper sheet having no image is reused by the above copying machine, it is possible to obtain a sheet of copying paper having a clear image.

The image formation and the regenerating operation are repeatedly performed ten times by similar operations. Thereafter, similar to the above case, an image is formed on the paper sheet. It is thus possible to obtain an image having a quality approximately equal to an image quality obtained when no paper sheet is used.

EMBODIMENT 26

An image removing accelerating liquid made by the following prescription is prepared as the high concentration liquid.

Surfactant polyoxyethylene alkyl 20 weight % phenyl ether antiseptics dehydropotassium acetate 0.3 weight % ion-exchanged water the remaining amount An image removing accelerating liquid made by the following prescription is prepared as the low concentration liquid.

Surfactant dodecyl benzene sodium 0.4 weight % sulfonate antiseptics dehydropotassium acetate 0.3 weight % ion-exchanged water the remaining amount A sheet of copying paper (regenerative wood free paper) commercially sold is used as the recorded material. An image is formed on this paper sheet by a copying machine (manufactured by RICHO, trade name FT5840) commercially sold. This paper sheet is regenerated by the following method. The regenerating apparatus is constructed by using the apparatus construction shown in FIG. 15. A polyester film having 75 $\mu$m in thickness is used as the separating member belt.

A providing portion of the image removing accelerating liquid at the first stage in the regenerating apparatus of FIG. 15 is filled with the above high concentration liquid. This high concentration liquid is provided to the recorded material such that a providing amount of the high concentration liquid is equal to 0.08 g/size A4. A providing portion of the image removing accelerating liquid at the second stage in the regenerating apparatus of FIG. 15 is filled with the above low concentration liquid. This low concentration liquid is provided to a rear face of the recorded material such that a providing amount of the low concentration liquid is equal to 0.9 g/size A4. An image is separated from such a recorded material having the provided image removing accelerating liquids at a linear velocity of 20 mm/sec while temperatures of the heating roller 32 and the pressurizing roller 31 are controlled such that these temperatures of the heating roller 32 and the pressurizing roller 31 are respectively equal to 120° C. and 105° C. Namely, the image is separated from the recorded material having the provided image removing accelerating liquids at the linear velocity of 20 mm/sec by holding temperatures of the recorded material such that the temperature of an image holding face of the recorded material is lower than that of the rear face of the recorded material. As a result, an image forming substance can be preferably separated from the recorded material so that no image is left on the recorded material.

In contrast to this, separating processing similar to the above image separating processing can be performed while the temperatures of the heating roller 32 and the pressurizing roller 31 are controlled such that the temperatures of the heating roller 32 and the pressuring roller 31 are respectively equal to 105° C. and 120° C. Namely, separating processing similar to the above image separating processing can be performed by holding the temperatures of the recorded material such that the temperature of the image holding face of the recorded material is higher than that of the rear face of the recorded material. In this case, an image is slightly left on the recorded material.

EMBODIMENT 27

An image removing accelerating liquid made by the following prescription is prepared as the high concentration liquid.

Surfactant polyoxyethylene alkyl 20 weight % phenyl ether wetting agent N-methyl-2-pyrrolidone 20 weight % antiseptics dehydropotassium acetate 0.3 weight % ion-exchanged water the remaining amount A providing portion of the image removing accelerating liquid at the first stage in the regenerating apparatus of FIG. 15 is filled with the above high concentration liquid. This high concentration liquid is provided to the recorded material such that a providing amount of the high concentration liquid is equal to 0.08 g/size A4. An image removing accelerating liquid made by the same prescription as the Embodiment 26 is used as the low concentration liquid. A providing portion of the image removing accelerating liquid at the second stage in the regenerating apparatus of FIG. 15 is filled with this low concentration liquid. This low concentration liquid is provided to a rear face of the recorded material such that a providing amount of the low concentration liquid is equal to 0.5 g/size A4. An image is separated from such a recorded material having the provided image removing accelerating liquids at a linear velocity of 20 mm/sec while temperatures of the heating roller 32 and the pressurizing roller 31 are controlled such that these temperatures of the heating roller 32 and the pressurizing roller 31 a re respectively equal to 120° C. and 105° C. Namely, the image is separated from the recorded material having the provided image removing accelerating liquids at the linear velocity of 20 mm/sec by holding temperatures of the recorded material such that the temperature of an image holding face of the recorded material is lower than that of the rear face of the recorded material. As a result, an image forming substance can be preferably separated from the recorded material so that no image is left on the recorded material.

A similar test is made by replacing N-methyl-2-pyrrolidone with ethylene glycol, diethylene glycol and diethylene glycol monoethyl ether in the wetting agent in the high concentration solution prescription. The image forming substance can be preferably separated from the recorded material when any one of these we tting agents is used. No image is left on the recorded material.

An image is slightly left on the recorded material when the high concentration liquid in the Embodiment 26 is used and the providing amount of the low concentration liquid is equal to 0.5 g/size A4 and the regenerating operation is similarly performed. Accordingly, effects of adding the wetting agent to the image removing accelerating liquid have been confirmed.

EMBODIMENT 28

An image removing accelerating liquid made by the following prescription is prepared as the high concentration liquid.

Surfactant polyoxyethylene alkyl 20 weight % phenyl ether antiseptics dehydropotassium acetate 0.3 weight % ion-exchanged water the remaining amount An image removing accelerating liquid made by the following prescription is prepared as the low concentration liquid.

Surfactant dodecyl benzene sodium 0.4 weight % sulfonate antiseptics dehydropotassium acetate 0.3 weight % ion-exchanged water the remaining amount A sheet of copying paper (regenerative wood free paper) commercially sold is used as the recorded material. An image is formed on this paper sheet by a copying machine (manufactured by RICHO, trade name FT5840) commercially sold. This paper sheet is regenerated by the following method. The regenerating apparatus is constructed by using the apparatus construction shown in FIG. 15. A polyester film having 75 $\mu$m in thickness is used as the separating member belt.

A providing portion of the image removing accelerating liquid at the first stage in the regenerating apparatus of FIG. 15 is filled with the above high concentration liquid. This high concentration liquid is provided to the recorded material such that a providing amount of the high concentration liquid is equal to 0.08 g/size A4. An image removing accelerating liquid made by the same prescription as the Embodiment 26 is used as the low concentration liquid. A providing portion of the image removing accelerating liquid at the second stage in the regenerating apparatus of FIG. 15 is filled with this low concentration liquid. This low concentration liquid is provided to a rear face of the recorded material such that a providing amount of the low concentration liquid is equal to 0.5 g/size A4. An image is separated from such a recorded material having the provided image removing accelerating liquids at a linear velocity of 20 mm/sec while temperatures of the heating roller 32 and the pressurizing roller 31 are controlled such that these temperatures of the heating roller 32 and the pressurizing roller 31 are respectively equal to 120° C. and 105° C. Namely, the image is separated from the recorded material having the provided image removing accelerating liquids at the linear velocity of 20 mm/sec by holding temperatures of the recorded material such that the temperature of an image holding face of the recorded material is lower than that of the rear face of the recorded material. As a result, an image forming substance can be preferably separated from the recorded material so that no image is left on the recorded material.

A similar test is made by replacing N-methyl-2-pyrrolidone with ethylene glycol, diethylene glycol and diethylene glycol monoethyl ether in the wetting agent in the high concentration solution prescription. The image forming substance can be preferably separated from the recorded material when any one of these wetting agents is used. No image is left on the recorded material.

An image is slightly left on the recorded material when the high concentration liquid in the Embodiment 26 is used and the providing amount of the low concentration liquid is equal to 0.5 g/size A4 and the regenerating operation is similarly performed. Accordingly, effects of adding the wetting agent to the image removing accelerating liquid have been confirmed.

EMBODIMENT 29

An image removing accelerating liquid made by the following prescription is prepared as the high concentration liquid.

Surfactant polyoxyethylene alkyl 10 weight % phenyl ether surfactant dialkyl sulfo sodium 10 weight % succinate antiseptics potassium sorbate 0.3 weight % ion-exchanged water the remaining amount A sheet of copying paper (wood free paper) commercially sold is used as the recorded material. An image is formed on this paper sheet by a copying machine (manufactured by RICHO, trade name FT6500) commercially sold. This paper sheet is regenerated by the following method. In the regenerating apparatus, the providing unit of the image removing accelerating liquid shown in FIG. 10 is replaced with the providing unit of the image removing accelerating liquid shown in FIG. 5. A polyester film having 75 $\mu$m in thickness is used as the separating member belt. A providing portion of the image removing accelerating liquid at the first stage in the regenerating apparatus of FIG. 10 is filled with the above high concentration liquid. This high concentration liquid is provided to the recorded material such that a providing amount of the high concentration liquid is equal to 0.25 g/size A4. A providing portion of the image removing accelerating liquid at the second stage in the regenerating apparatus of FIG. 16 is filled with an aqueous solution obtained by dissolving a 0.3 weight % potassium sorbate as antiseptics into water. This aqueous solution as the low concentration liquid is provided to a rear face of the recorded material such that a providing amount of this aqueous solution is equal to 0.8 g/size A4.

An image is separated from such a recorded material having the provided image removing accelerating liquids at a linear velocity of 20 mm/sec while temperatures of the heating roller 32 and the pressurizing roller 31 are controlled such that these temperatures of the heating roller 32 and the pressurizing roller 31 are respectively equal to 120° C. and 105° C. Namely, the image is separated from the recorded material having the provided image removing accelerating liquids at the linear velocity of 20 mm/sec by holding temperatures of the recorded material such that the temperature of an image holding face of the recorded material is lower than that of the rear face of the recorded material. As a result, an image forming substance can be preferably separated from the recorded material so that no image is left on the recorded material.

In the above regenerating operation, a small black mark point is stamped by a stamp on the recorded material regenerated after dry so that regenerative processing of the recorded material can be recognized. An image is again formed on the above recorded material as a regenerated paper sheet by the above copying machine. When this paper sheet is regeneratively processed, the copying machine detects this mark showing the regenerative processing. In this case, the copying machine is adjusted such that the recorded material is conveyed to the guide plate 252 in FIG. 10 and does not pass through the providing portion of the image removing accelerating liquid at the first stage. When an image is formed on the above regenerated paper sheet and this paper sheet as the recorded material is processed by this copying machine, the image forming substance can be preferably separated from the paper sheet by providing only water to the paper sheet without providing no high concentration liquid to the paper sheet in the second or subsequent regenerative processing. No image is left on the recorded material.

EMBODIMENT 30

An image removing accelerating liquid made by the following prescription is prepared.

Surfactant BT-7 1 weight % surfactant perfluoroalkyl ammonium 1 weight % carboxylate wetting agent glycerol 1.5 weight % antiseptics 2-pyridine thiol-1-0.2 weight % sodium oxide salt ion-exchanged water the remaining amount A sheet of copying paper (wood free paper) commercially sold is used as the recorded material. An image is formed on this paper sheet by a copying machine (manufactured by RICHO, trade name FT6500) commercially sold. This paper sheet is regenerated by the following method. In the regenerating apparatus, the providing unit of the image removing accelerating liquid shown in FIG. 11 is replaced with the providing unit of the image removing accelerating liquid shown in FIG. 5. A polyester film having 75 $\mu$m in thickness is used as the separating member belt. The above image removing accelerating liquid is provided to the recorded material clamped on the drum 295 by the image removing accelerating liquid providing unit shown in FIG. 11. In this case, the providing amount of the image removing accelerating liquid is adjusted to 0.4 g/size A4 every one rotation of the drum 295.

When an image is recorded onto a sheet of unused paper and this paper sheet is processed as the recorded material, the regenerating apparatus is adjusted such that the drum 295 passes through a liquid providing means two times. The image is separated from the recorded material having the provided image removing accelerating liquid at a linear velocity of 20 mm/sec while temperatures of the heating roller 32 and the pressurizing roller 31 are controlled such that these temperatures of the heating roller 32 and the pressurizing roller 31 are respectively equal to 120° C. and 105° C. Namely, the image is separated from the recorded material having the provided image removing accelerating liquid at the linear velocity of 20 mm/sec by holding temperatures of the recorded material such that the temperature of an image holding face of the recorded material is lower than that of a rear face of the recorded material. As a result, an image forming substance can be preferably separated from the recorded material so that no image is left on the recorded material.

In the above regenerating operation, a small black mark point is stamped by a stamp on the recorded material regenerated after dry so that regenerative processing of the recorded material can be recognized. An image is again formed on the above recorded material as a regenerated paper sheet by the above copying machine. When this paper sheet is regeneratively processed, the copying machine detects this mark showing the regenerative processing. The regenerating apparatus of FIG. 11 is adjusted such that the drum 295 passes through a liquid providing means only once. Similar to the above case, the image forming substance is then separated from the paper sheet. In this case, the image forming substance can be preferably separated from the recorded material so that no image is left on the recorded material. Accordingly, it has been confirmed that the image forming substance can be preferably separated from the regeneratively processed recorded material even when the number of provisions of the image removing accelerating liquid is reduced, i.e., even when the providing amount of the image removing accelerating liquid is small.

Concrete embodiment modifications of the present invention are shown as follows.

1. A regenerating method of a recorded material characterized in that at least a portion of the recorded material in the vicinity of a surface thereof on an image forming side is wet and expands with a liquid;

the wet and expanding liquid (also called an image removing accelerating liquid in the following description) is provided to the recorded material so that the portion of the recorded material in the vicinity of the surface thereof is wet and expands with this liquid;

a separating member comes in contact with an image forming substance having a film shape and a thermoplastic or thermally melted property and formed in the vicinity of the surface of the recorded material in a state in which joining force between the image forming substance and the recorded material is reduced; and an image in the vicinity of the surface of the recorded material is transferred onto the separating member so that the image forming substance on the recorded material is removed therefrom;

said image removing accelerating liquid being divisionally provided to the same recorded material plural times.

2. The above first regenerating method of the recorded material, wherein the image removing accelerating liquid is substantially made by the same prescription.

3. The above second regenerating method of the recorded material characterized in that the image removing accelerating liquid is divisionally provided to the recorded material two times.

4. The above second or third regenerating method of the recorded material having at least one coating process in which both front and rear faces of the recorded material in at least a front end portion thereof are coated with the image removing accelerating liquid.

5. The first, second or third regenerating method of the recorded material, wherein the image removing accelerating liquid is constructed by an aqueous solution including water, a surfactant and/or a water-soluble polymer; and a content of the surfactant and/or the water-soluble polymer in the aqueous solution ranges from 0.01 to 20 weight %.

6. The above first, second, third or fourth regenerating method of the recorded material in which the image removing accelerating liquid includes an agent for reducing surface tension, for example, an alcohol class such as methanol, ethanol, etc., a water-soluble organic compound such as acetone, carbitol, sorbitol, etc.

7. The above first, second, third, fourth, fifth or sixth regenerating method of the recorded material in which surface tension of the image removing accelerating liquid is adjusted to 50 mN/m or less.

8. The above first regenerating method of the recorded material in which an inc luding concentration of the surfactant of the image removing accelerating liquid divisionally provided to the recorded material plural times is reduced as the image removing accelerating liquid is provided to the recorded material in a later process;

a high concentration liquid having the surfactant of a high concentration ranging from 5 to 100 weight % is provided onto at least a holding face of the recorded material holding the image forming substance in a range from 16 $\mu g/cm^2$ to 1.6 $mg/cm^2$ (0.01 to 1 g per size A4); and a low concentration water-s oluble liquid or water including the surfactant of a concentration equal to or smaller than 5 weight %, preferably 0.05 to 2 weight %, more preferably 0.2 to 2 weight % is then provided to the recorded material in a range from 16 $\mu g/cm^2$ to 3.2 $mg/cm^2$ (0.01 to 2 g per size A4).

9. The above eighth regenerating method of the recorded material in which the recorded material is constructed by general wood free paper.

10. The above seventh or eighth regenerating method of the recorded material in which the low concentration water-soluble liquid is constructed by a liquid including the surfactant of a concentration equal to or smaller than 5 weight %, or including no surfactant such as an aqueous solution including only a water-soluble polymer and an antiseptic mildewproofing agent, or a liquid composed of only water.

11. The above eighth, ninth or tenth regenerating method of the recorded material in which the low concentration water-soluble liquid is provided to the recorded material from a rear face (an image non-holding face) thereof.

12. The above eighth, ninth, tenth or eleventh regenerating method of the recorded material in which the high concentration liquid has excellent compatibility with respect to at least one kind of water and includes a wetting agent as a compound having a vapor pressure lower than that of water.

13. The above eighth, ninth, tenth, eleventh or twelfth regenerating method of the recorded material in which the recorded material having the provided image removing accelerating liquid is heated such that the temperature of an image forming substance holding face of the recorded material is lower than that of a rear face thereof.

14. A regenerating apparatus of a recorded material comprising at least:

means for providing a liquid (an image removing accelerating liquid) for making wet and expanding a portion of the recorded material in the vicinity of a surface thereof to the same recorded material plural times; and means for transferring an image forming substance on the recorded material to a separating member by pressurizing and/or heating the recorded material and the separating member after the recorded material having the provided liquid is joined to the separating member.

15. The above fourteenth regenerating apparatus of the recorded material in which the regenerating apparatus further comprises plural mechanisms for providing the image removing accelerating liquid to the recorded material; and the image removing accelerating liquid substantially made by the same prescription is divisionally provided to the same recorded material plural times.

16. The above fifteenth regenerating apparatus of the recorded material in which the regenerating apparatus further comprises a tank for commonly storing the image removing accelerating liquid provided to the recorded material.

17. The fourteenth regenerating apparatus of the recorded material in which the regenerating apparatus further comprises means for conveying the recorded material such that the recorded material passes through the same liquid providing means plural times; and the image removing accelerating liquid substantially made by the same prescription is provided to the same recorded material.

18. The above seventeenth regenerating apparatus of the recorded material in which the conveying means for conveying the recorded material through the same liquid providing means plural times is constructed by recorded material clamping means arranged in a roller for fixing a front end of the recorded material, and means for rotating the roller having the clamping means.

19. The above fourteenth regenerating apparatus of the recorded material in which the regenerating apparatus further comprises:

at least two liquid providing means composed of liquid providing means for providing a high concentration liquid including the surfactant of a high concentration ranging from 5 to 100 weight % to the recorded material such that a providing amount of this high concentration liquid ranges from 16 $\mu g/cm^2$ to 1.6 $mg/cm^2$ (0.01 to 1 g per size A4); and liquid providing means for providing a low concentration water-soluble liquid including the surfactant of a concentration equal to or smaller than 5 weight % to the recorded material such that a providing amount of this low concentration water-soluble liquid ranges from 16 $\mu g/cm^2$ to 3.2 $mg/cm^2$ (0.01 to 2 g per size A4); and conveying means for conveying the recorded material to the high concentration liquid providing means such that the high concentration liquid is provided to a holding face of the image forming substance to be removed;

the conveying means conveying the recorded material to the providing means of the low concentration water-soluble liquid or water after the recorded material is conveyed to the high concentration liquid providing means.

20. The above nineteenth regenerating apparatus of the recorded material in which the providing means of the low concentration water-soluble liquid uses city water.

21. The above nineteenth or twentieth regenerating apparatus of the recorded material in which at least the providing means of the low concentration water-soluble liquid among the providing means of the high concentration liquid and the low concentration water-soluble liquid provides the low concentration water-soluble liquid to the recorded material by liquid dropping.

22. The above nineteenth, twentieth or twenty-first regenerating apparatus of the recorded material in which at least the providing means of the low concentration water-soluble liquid or water among the providing means of the high concentration liquid and the low concentration water-soluble liquid is constructed such that both front and rear faces of the recorded material in at least a front end portion thereof are coated with the low concentration water-soluble liquid.

23. The above nineteenth, twentieth, twenty-first or twenty-second regenerating apparatus of the recorded material in which the regenerating apparatus further comprises means for heating and pressurizing the recorded material and the separating member such that the temperature of a holding face of the recorded material holding the image forming substance to be removed is lower than the temperature of a rear face of the recorded material; and this means transfers the image forming substance from the recorded material to the separating member.

24. The above nineteenth, twentieth, twenty-first, twenty-second or twenty-third regenerating apparatus of the recorded material in which the regenerating apparatus further comprises means for judging the number of regenerative processings performed before regenerative processing of the recorded material; and control means for changing the number of provisions of the image removing accelerating liquid in accordance with the number of regenerative processings.

25. The above twenty-fourth regenerating apparatus of the recorded material in which the regenerating apparatus further comprises control means for controlling the number of provisions of the high concentration liquid in accordance with the number of regenerative processings performed and judged before the regenerative processing.

26. The above twenty-fourth or twenty-fifth regenerating apparatus of the recorded material in which the selective control means for changing the number of provisions of the image removing accelerating liquid in accordance with the number of executed regenerative processings controls an operation of the providing means of the image removing accelerating liquid.

27. The above twenty-fourth or twenty-fifth regenerating apparatus of the recorded material in which the control means having plural conveying paths of the recorded material for changing the number of provisions of the image removing accelerating liquid and changing the number of provisions of the image removing accelerating liquid in accordance with the number of executed regenerative processings selects the plural conveying paths of the recorded material.

EFFECTS

1. A required amount of an image removing accelerating liquid can be reduced in comparison with a case in which the image removing accelerating liquid is provided to a recorded material at only one time. As a result, it is possible to solve problems caused when the image removing accelerating liquid is provided to the recorded material at only one time. Namely, it is possible to prevent an increase in power consumption for heating the recorded material at separating and drying times of the recorded material. It is also possible to prevent a conveying property of paper from being reduced by a reduction in paper strength after the recorded material is coated with the image removing accelerating liquid. Further, a paper jam can be prevented within a regenerating apparatus and it is possible to prevent wrinkles in the recorded material from tending to be caused. Furthermore, it is possible to prevent paper from tending to extend at a regenerative processing time. The image removing accelerating liquid is provided to the recorded material at many stages. Accordingly, when coating irregularities of the image removing accelerating liquid are caused at each of liquid providing times, the image removing accelerating liquid can be provided to the recorded material averagely and uniformly as a whole so that reliability in provision of the image removing accelerating liquid can be improved.

2. The image removing accelerating liquid made by the same prescription is divisionally provided to the recorded material plural times. Accordingly, it is possible to prevent generations of curl, wavy deformation and wrinkles of the recorded material caused when the recorded material is coated with a large amount of the image removing accelerating liquid at one time. An image forming substance on the recorded material is cracked by providing the image removing accelerating liquid at a previous providing stage to the recorded material using many divisional liquid providing stages. Therefore, the image removing accelerating liquid provided at a later providing stage easily permeates the image forming substance. Accordingly, the image forming substance can be preferably removed from the recorded material even when a providing amount of the image removing accelerating liquid is small. Further, copying characteristics of the recorded material are excellent after the recorded material is repeatedly regenerated. Further, since the image removing accelerating liquid is provided to the recorded material at many stages, the image removing accelerating liquid can be provided to the recorded material averagely and uniformly as a whole even when coating irregularities of the image removing accelerating liquid are caused at each of the liquid providing times.

3. No image forming substance can be sufficiently separated from the recorded material when the content of a surfactant or/and a water-soluble polymer is equal to or smaller than 0.01 weight %.

In contrast to this, when this content is equal to or greater than 20 weight %, there is a condition in which the image forming substance can be separated from the recorded material. However, characteristics of the regenerated recorded material are changed so that writing characteristics of the recorded material are reduced and an image quality at a recopying time is reduced. Further, wrinkles tend to be caused at the recopying time and the number of regenerable times is reduced.

4. A surfactant concentration is reduced as the image removing accelerating liquid is provided to the recorded material in a later process. Accordingly, the providing amount of the image removing accelerating liquid can be reduced. Further, since no unnecessary surfactant is provided to the recorded material, it is possible to prevent characteristics of the regenerated recorded material from being changed so that no writing characteristics of the recorded material are reduced and no image quality at a recopying time is reduced. Further, no wrinkles tend to be caused at the recopying time and the number of regenerable times is not reduced.

5. A low concentration water-soluble liquid is provided to the recorded material from a rear face (non-image holding face side) thereof. Accordingly, the image removing accelerating liquid tends to permeate an interface between the recorded material and the image forming substance so that adhesive force between the recorded material and the image forming substance can be effectively weakened.

When the image forming substance is completely formed in a film shape and an image having a wide area such as a full image is formed on the recorded material, it is difficult to separate the image from the recorded material when the low concentration liquid is provided to the recorded material from its image holding face. It is particularly effective to separate such an image from the recorded material by providing the low concentration liquid to the rear face of the recorded material.

6. The high concentration liquid includes a wetting agent. Accordingly, when the image forming substance is transferred from the recorded material, the low concentration water-soluble liquid or water is trapped in the wetting agent even when the recorded material is heated. Therefore, the image forming substance can be preferably removed from the recorded material even when a providing amount of the low concentration water-soluble liquid or water is small.

7. The image forming substance can be preferably transferred to the separating member from the recorded material by using the regenerating method of the invention after the image removing accelerating liquid is provided to the recorded material by using each of the above regenerating methods. Further, the image forming substance can be separated from the recorded material by a small providing amount of the image removing accelerating liquid in comparison with a case in which a temperature gradient of the recorded material is reverse.

8. A regenerating apparatus has a mechanism for preferably regenerating the recorded material and divisionally providing the image removing accelerating liquid to the recorded material plural times. Accordingly, a required amount of the image removing accelerating liquid can be reduced in comparison with the case of a single liquid providing process. As a result, it is possible to provide a regenerating apparatus of the recorded material for solving problems caused when the single liquid providing process is used. Namely, it is possible to prevent an increase in power consumption for heating the recorded material at separating and drying times of the recorded material. It is also possible to prevent a conveying property of paper from being reduced by a reduction in paper strength after the recorded material is coated with the image removing accelerating liquid. Further, a paper jam can be prevented within the regenerating apparatus and it is possible to prevent wrinkles in the recorded material from tending to be caused. Furthermore, it is possible to prevent paper from tending to extend at a regenerative processing time.

9. When composition of the image removing accelerating liquid is changed by evaporation of a liquid component, etc., the image removing accelerating liquid in each of liquid providing parts is commonly provided to the recorded material so that the composition of the image removing accelerating liquid in each of the liquid providing parts becomes constant. Accordingly, the image forming substance can be stably separated from the recorded material. For example, when water in the image removing accelerating liquid is evaporated so that the composition of the image removing accelerating liquid is changed, it is possible to provide a regenerating apparatus of the recorded material in which a device for supplying water by its evaporating amount, etc. is easily arranged.

10 When the image removing accelerating liquid made by the same prescription is divisionally provided to the recorded material plural times, the apparatus construction can be made compact and liquid providing effects at many stages can be obtained by a simple construction of the regenerating apparatus of the recorded material.

11. A high concentration liquid and a low concentration water-soluble liquid or water are sequentially provided to the recorded material in the regenerating apparatus. Thereafter, the image forming substance is separated from the recorded material.

12. The low concentration water-soluble liquid or water is provided to the recorded material in non-contact so that no high concentration liquid component is mixed into the low concentration liquid. Accordingly, the composition of the image removing accelerating liquid is excellently stabilized with the passage of time. Therefore, there is no scatter of the liquid providing amount and the image forming substance is stably separated from the recorded material. Further, a constant amount of the image removing accelerating liquid can be provided to the recorded material irrespective of absorbing characteristics of the recorded material with respect to the image removing accelerating liquid. Therefore, when many kinds of recorded materials are regeneratively processed, separating characteristics of the image forming substance are stably obtained by the regenerating apparatus of the recorded material without changing any liquid providing condition.

13. A providing means of the low concentration water-soluble liquid provides the low concentration water-soluble liquid to both front and rear faces of the recorded material in at least a front end portion thereof. Accordingly, it is possible to provide a regenerating apparatus of the recorded material capable of reducing a curling amount of the recorded material in the front end portion, a paper jam, generation of wrinkles, etc.

14. The image removing accelerating liquid easily permeates an interface between the recorded material and the image forming substance so that adhesive force between the recorded material and the image forming substance can be effectively weakened. Therefore, the image forming substance can be effectively separated from the recorded material by the regenerating apparatus of the recorded material with a small amount of the image removing accelerating liquid.

15. When the regenerative process ing of the recorded material is executed plural times, it is possible to reduce an increasing rate of an accumulating amount of an image removing accelerating liquid component within the recorded material. Accordingly, a change in characteristics of the recorded material can be reduced so that the number of reusable times of the recorded material can be increased in the regenerating apparatus of the recorded material.

16. No high concentration liquid is provided to the recorded material in the regenerative processing of the recorded material regeneratively processed once by using the high concentration liquid and the low concentration liquid. Accordingly, accumulation of the image removing accelerating liquid in the recorded material caused by repetition of the regenerative processing can be greatly reduced. Therefore, the effects of the invention can be further improved and the number of reusable times of the recorded material is greatly increased.

BRIEF DESCRIPTION OF THE DRAWINGS

FIG. 3(*b*) is a view for explaining an action of the image removing accelerating liquid when the surfactant concentration is high.

EXPLANATION OF REFERENCE NUMERALS

Figure 1:
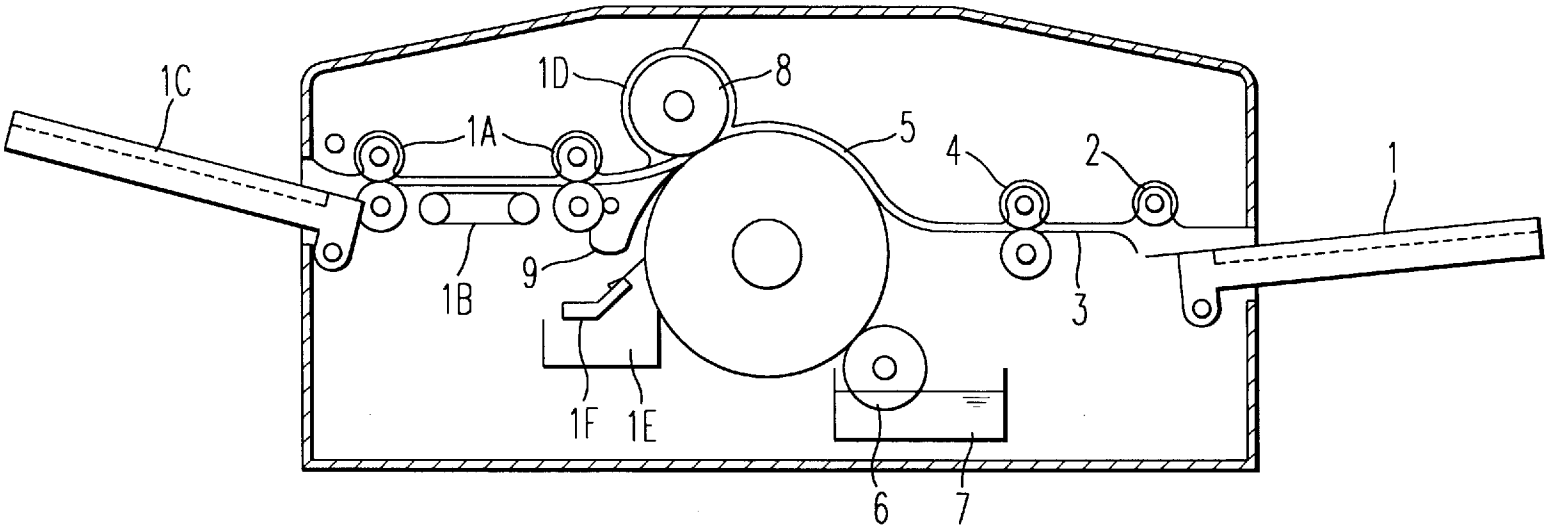
FIG. 1 is a view showing one example of a general apparatus for regenerating a recorded material and proposed by the inventors of this patent application.
Figure 2:
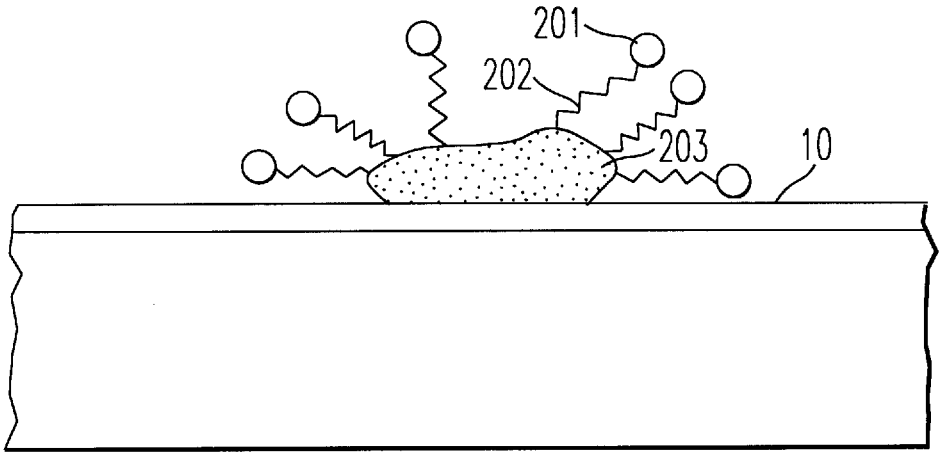
FIG. 2 is a view for explaining an action of a surfactant with respect to an image forming substance.
Figure 3A:
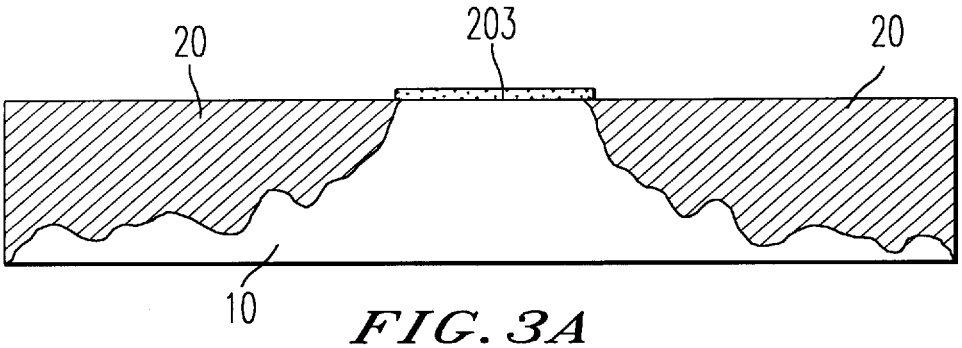
FIG. 3(*a*) is a view for explaining an action of the image removing accelerating liquid when a surfactant concentration is low.
Figure 3B:
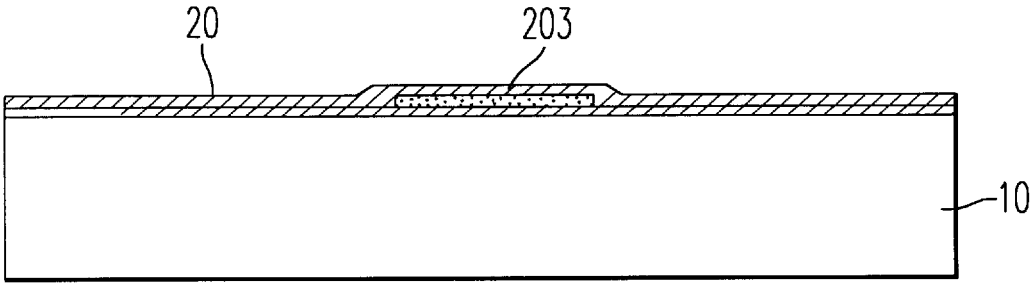
Figure 5:
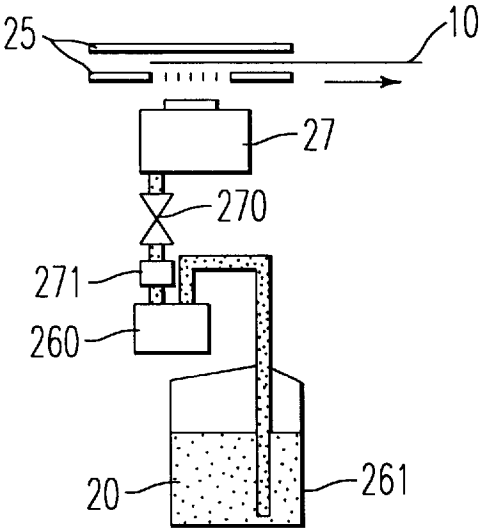
FIG. 5 is a view showing a liquid drop providing portion in which the image removing accelerating liquid is provided to the recorded material by liquid dropping.
Figure 4:
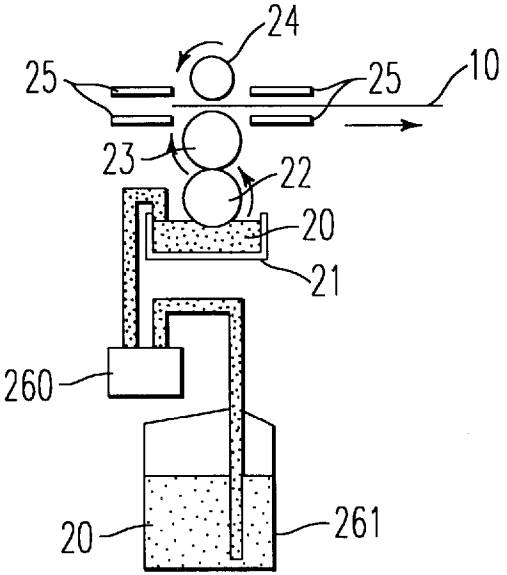
FIG. 4 is a view showing a coating portion in which the image removing accelerating liquid is provided to the recorded material by a coating roller.
Figure 6:
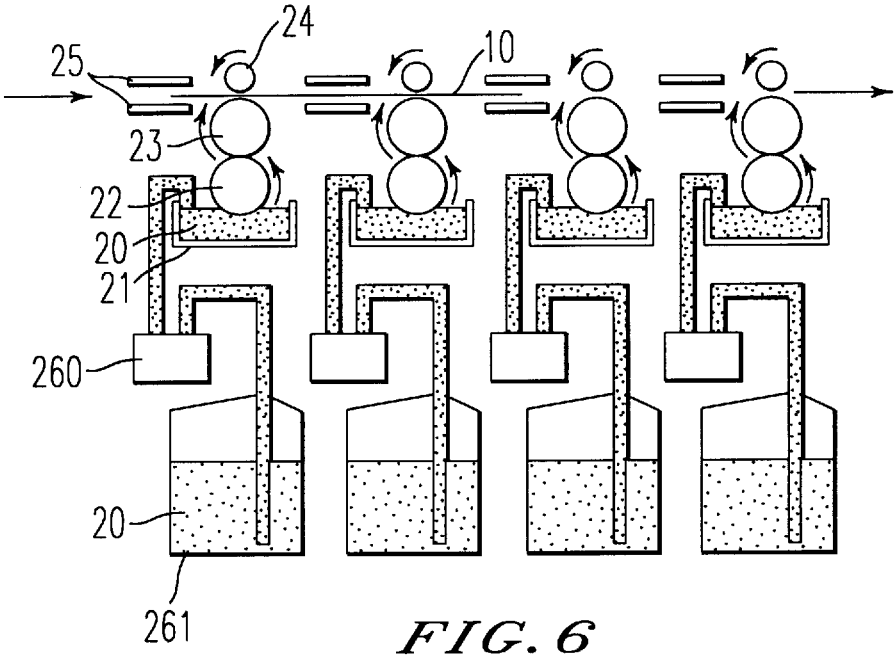
FIG. 6 is a view showing a coating section constructed by four units of coating portions each shown in FIG. 4.
Figure 7:
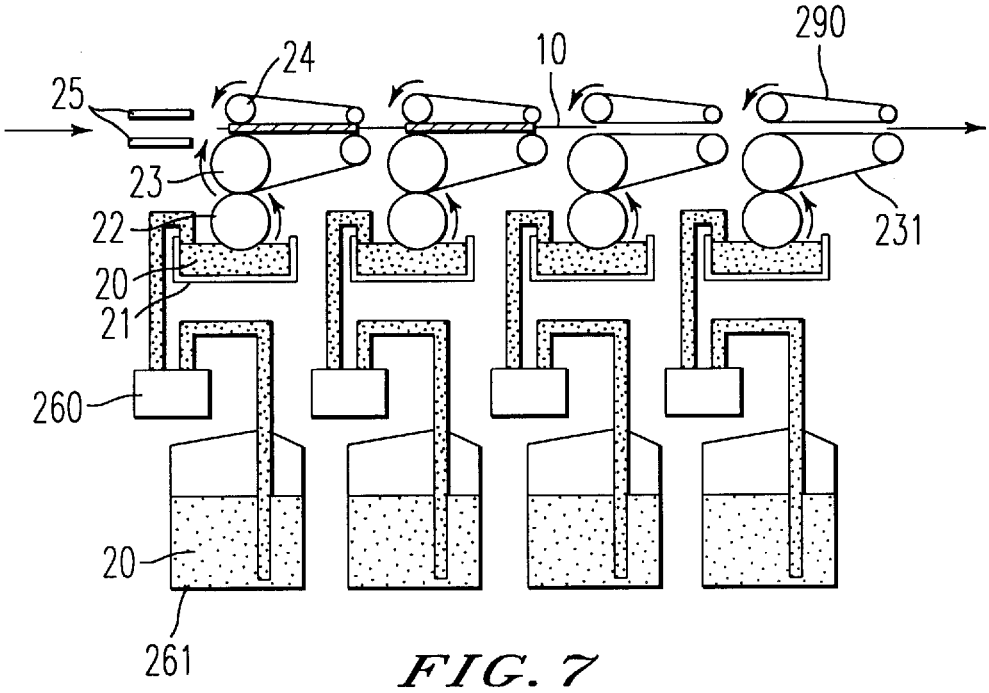
FIG. 7 is a view showing a coating portion in which the image removing accelerating liquid is provided to the recorded material by using a coating roller and a pressing belt.
Figure 8:
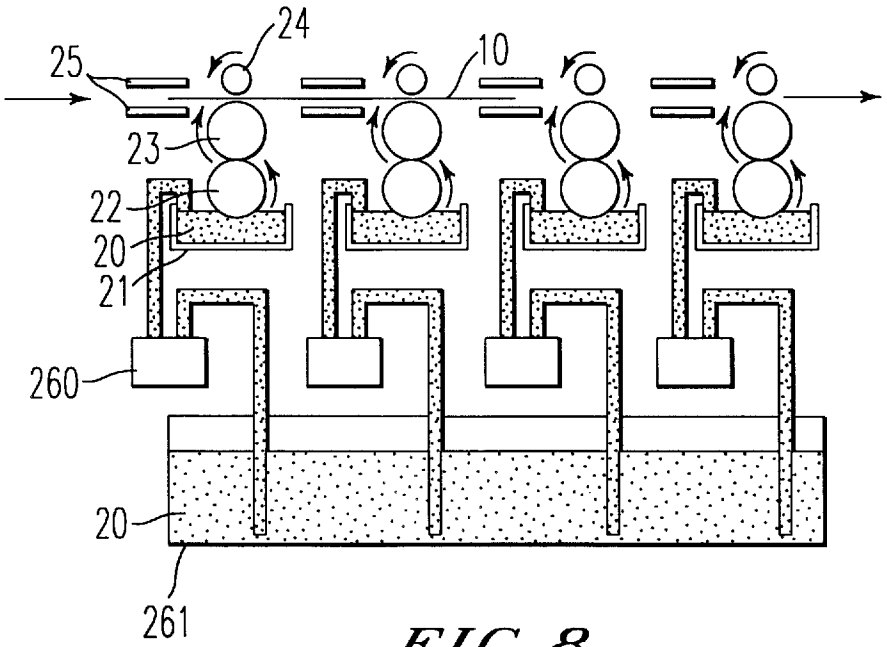
FIG. 8 is a view showing supplying and coating portions of the image removing accelerating liquid which have a means for divisionally providing the image removing accelerating liquid made in the same prescription to the same recorded material plural times by commonly using a supplying source (tank) of the image removing accelerating liquid.
Figure 9:
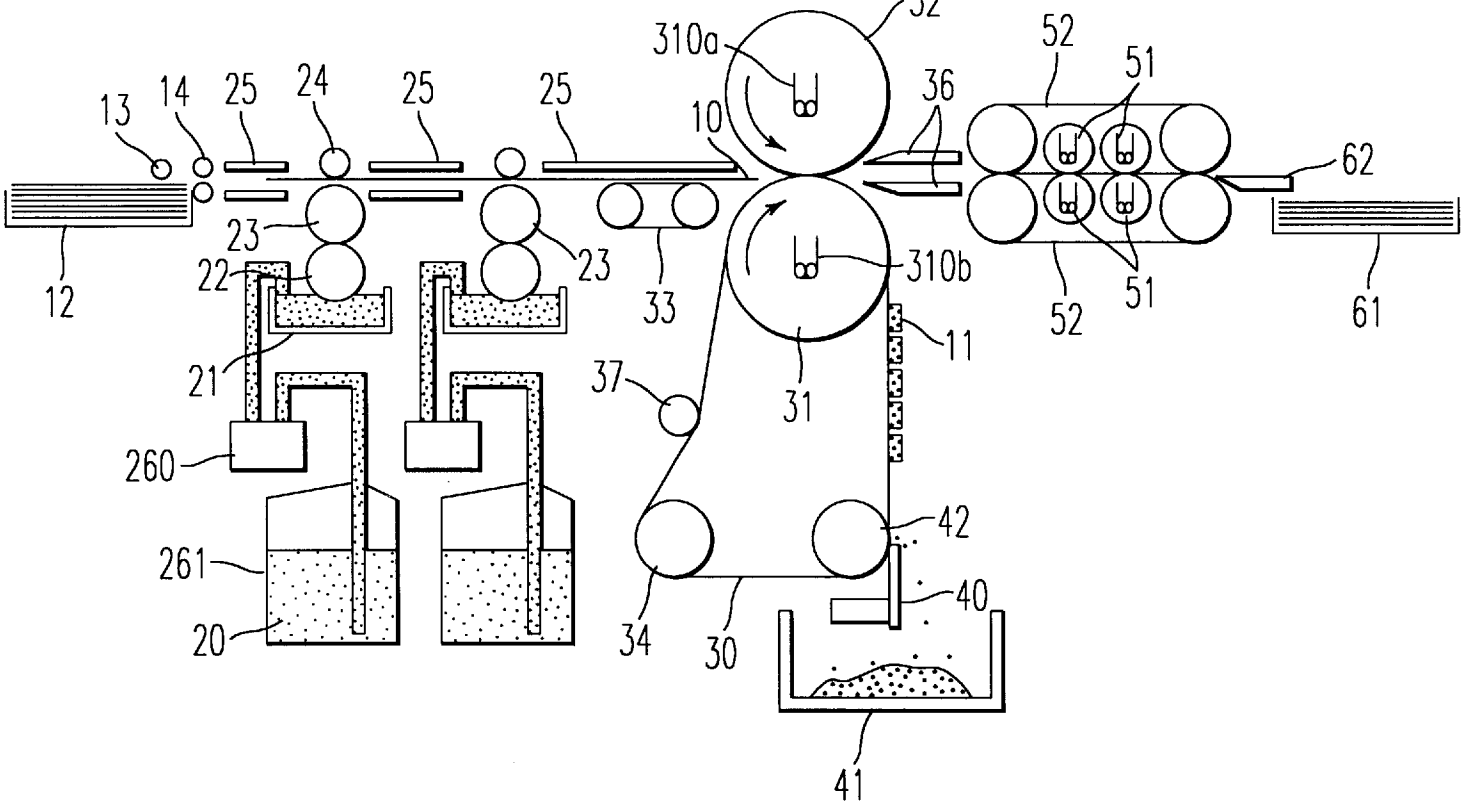
FIG. 9 is a view showing one example of an entire regenerating apparatus of the recorded material in the present invention.
Figure 10:
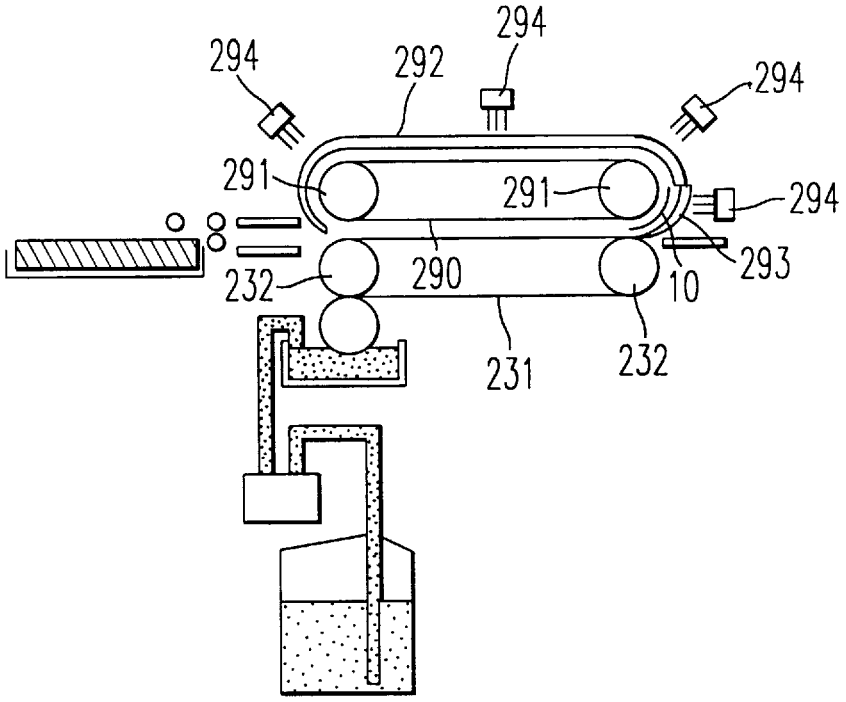
FIG. 10 is a view showing a coating portion of the image removing accelerating liquid which has a conveying means constructed such that the recorded material passes through the same image removing accelerating liquid providing means plural times.
Figure 11:
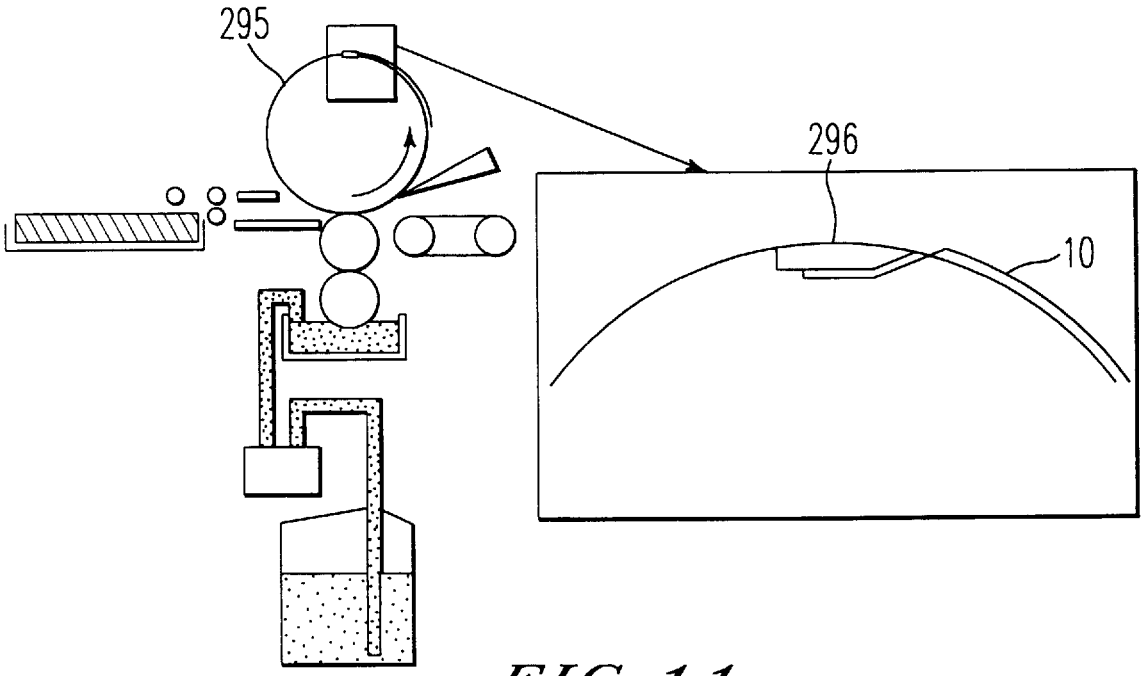
FIG. 11 is a view showing another modifying example of the coating portion of the image removing accelerating liquid which has the conveying means constructed such that the recorded material passes through the same image removing accelerating liquid providing means plural times.
Figure 12:
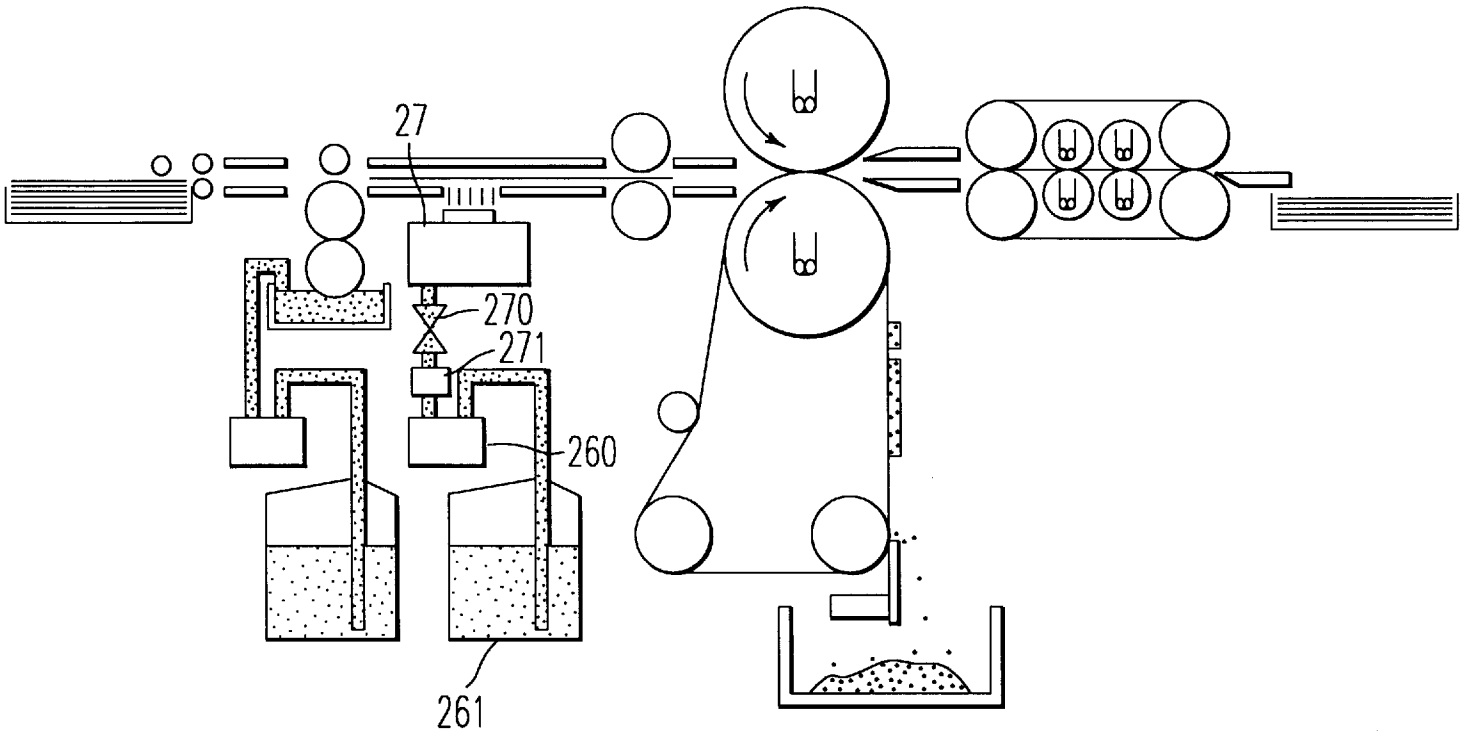
FIG. 12 is a view showing a regenerating apparatus in which the image removing accelerating liquid is provided to the recorded material by liquid dropping instead of a roller coating system at a second stage in the regenerating apparatus shown in FIG. 9.
Figure 13:
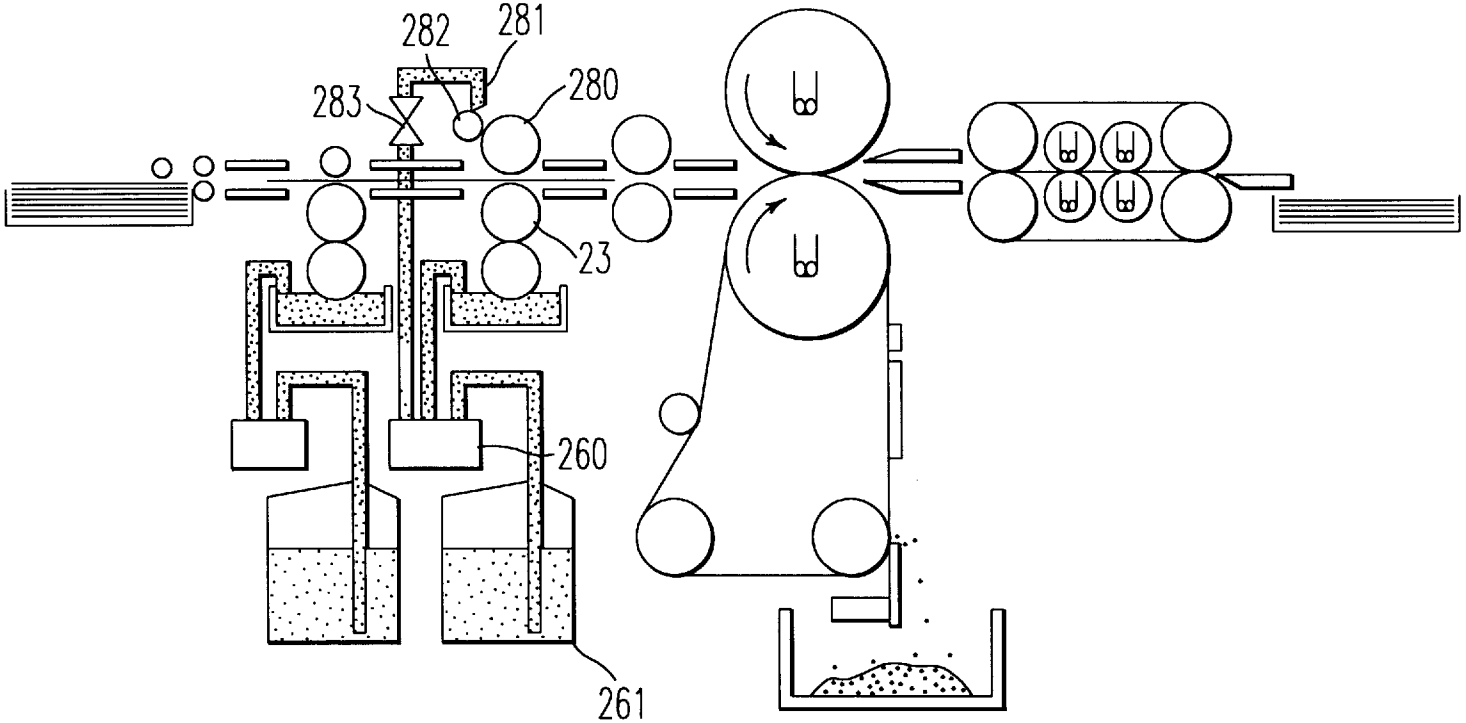
FIG. 13 is a view showing a regenerating apparatus in which the image removing accelerating liquid at the second stage in the regenerating apparatus shown in FIG. 9 is provided to the recorded material from b oth sides of an image holding face and an image non-holding face.
Figure 14:
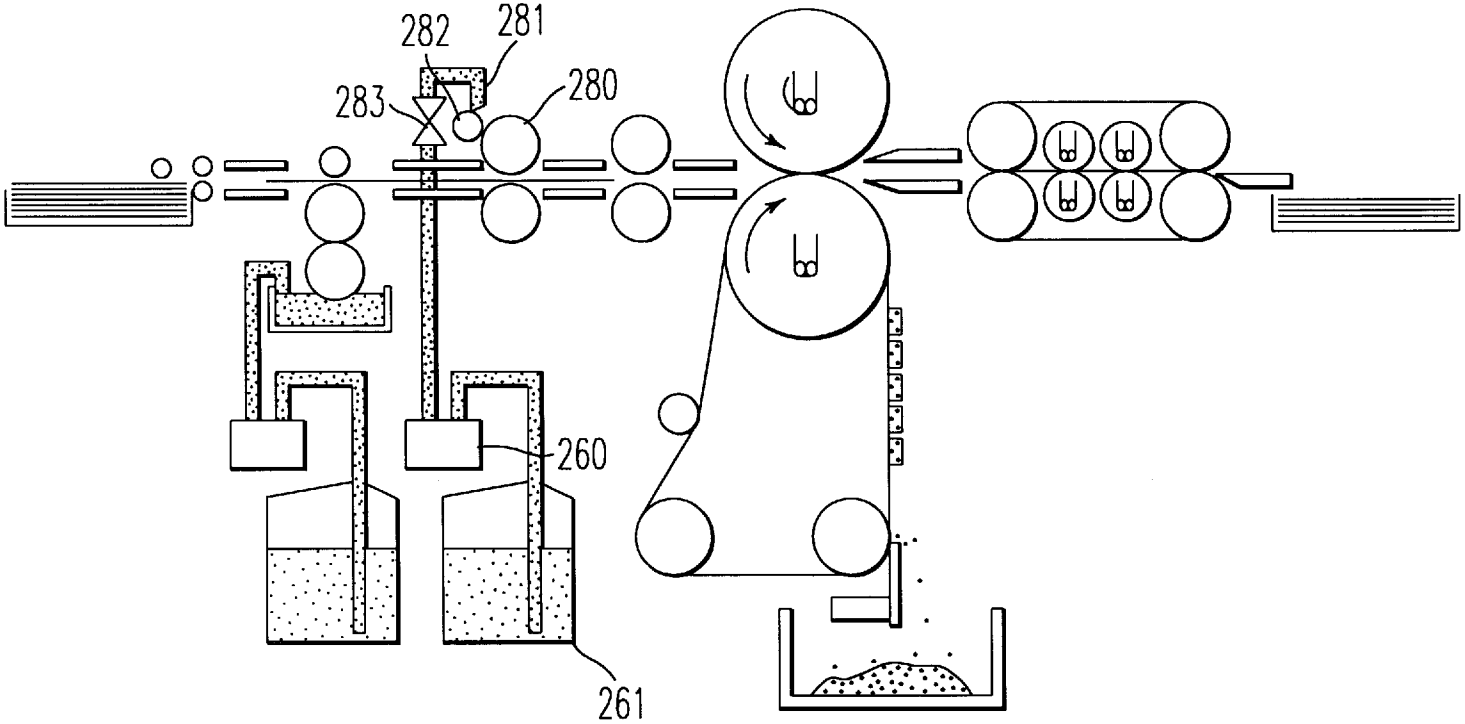
FIG. 14 is a view showing a regenerating apparatus in which the image removing accelerating liquid at the second stage in the regenerating apparatus shown in FIG. 9 is provided to the recorded material from its image non-holding face side by a roller system.
Figure 15:
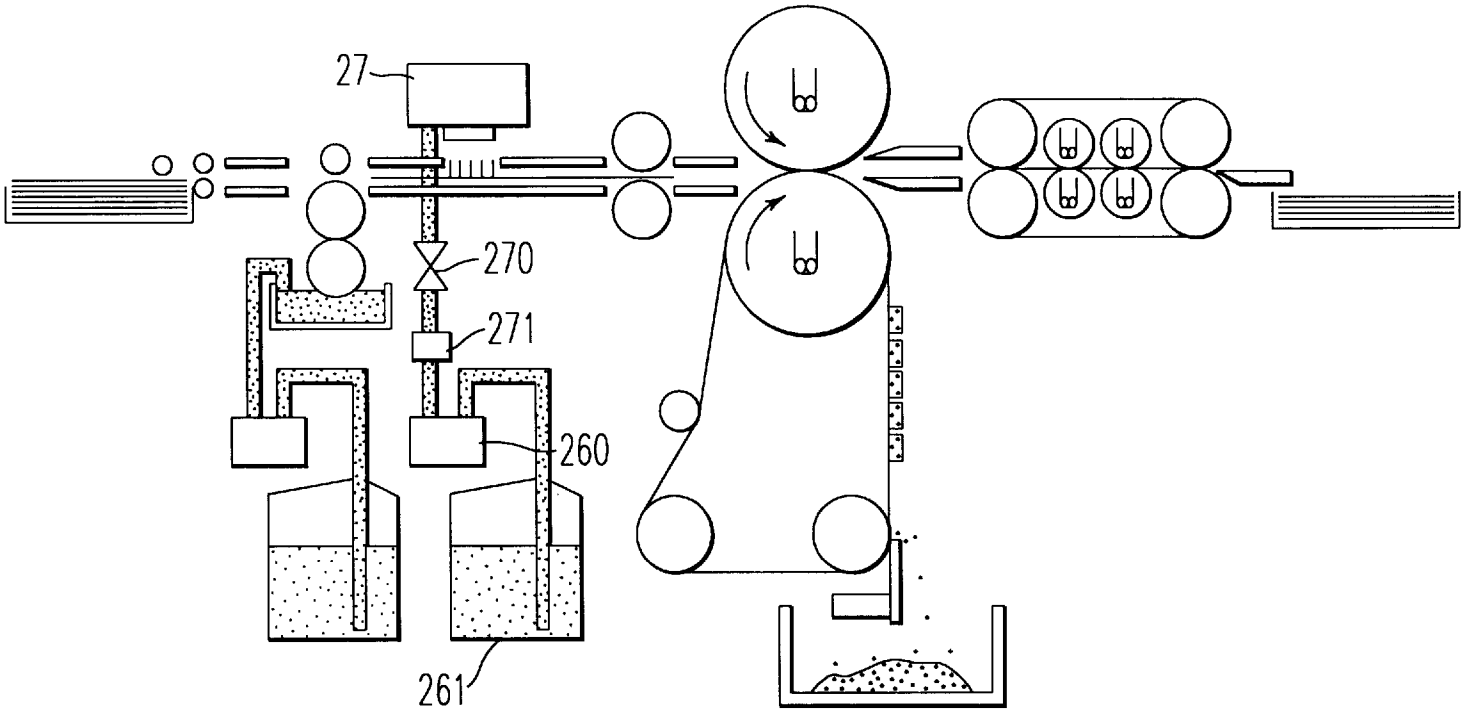
FIG. 15 is a view showing a regenerating apparatus in which the image removing accelerating liquid at the second stage in the regenerating apparatus shown in FIG. 9 is provided to the recorded material from its image non-holding face sid e by liquid dropping.
Figure 16:
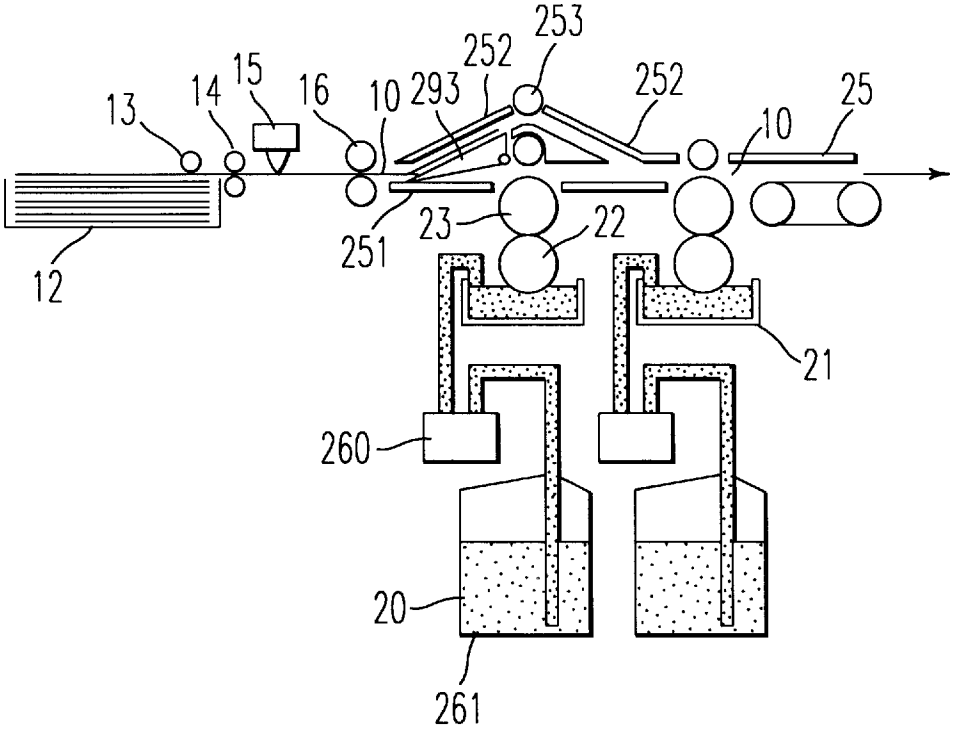
FIG. 16 is a view showing a regenerating apparatus in which plu ral conveying p aths of the image removing accelerat ing liquid are arranged such that liquid providing numbers can be set to be different from each other in accordance with existence and nonexistence of experience of regenerative processing of the recorded material and the number of experiences of the regenerative processing.
Figure 17:
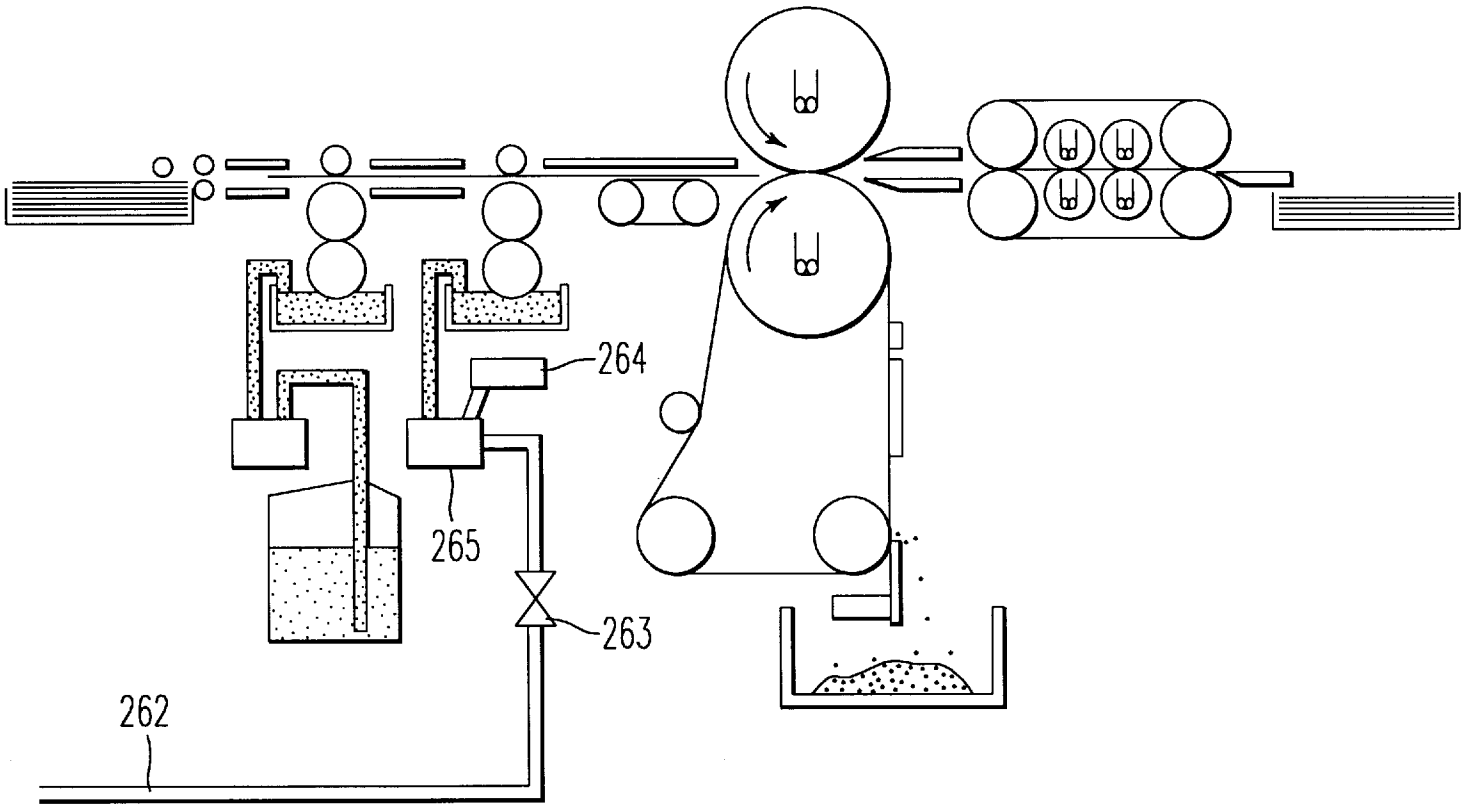
FIG. 17 is a view showing a regenerating apparatus constructed such that city water is used as a low concentration water-soluble liquid.
Figure 18:
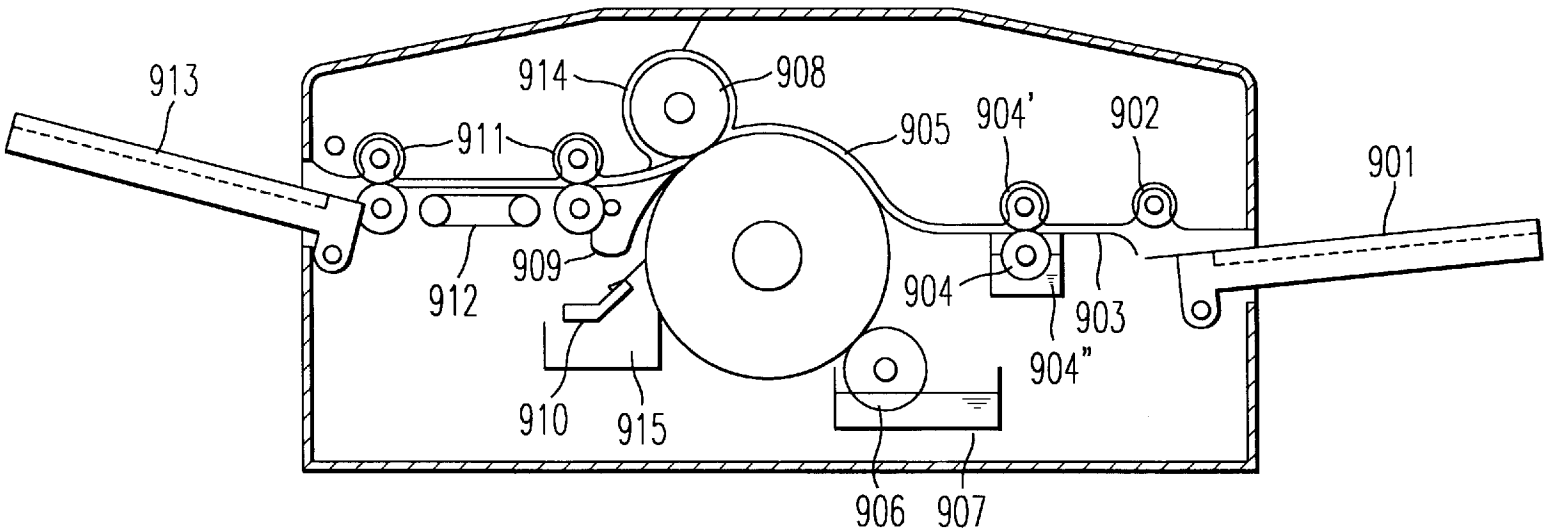
FIG. 18 is a view showing a regenerating apparatus used in Embodiment 3.

1 - - - paper feed tray, 2 - - - paper feed roller, 3 - - - guide plate, 4 - - - conveying roller, 5 - - - separating roller, 6 - - - coating roller, 7 - - - separating liquid, 8 - - - heating roller, 9 - - - separating claw, 1A - - - conveying roller, 1B - - - drying belt, 1C - - - paper discharging tray, 1D - - - conveying rib, 1E - - - collecting container of collective thermally flexible ink, 1F - - - toner cleaning portion, 10 - - - recorded material, 11 - - - image forming substance, 12 - - - paper feed tray, 13 - - - paper feed roller, 14 - - - resist roller pair, 15 - - - regenerative processing number judging means, 16 - - - conveying roller pair, 20 - - - image removing accelerating liquid, 201 - - - hydrophilic group, 202 - - - hydrophobic group, 203 - - - image forming substance, 21 - - - image removing accelerating liquid container, 22 - - - drawing-up roller, 23 - - - coating roller, 231 - - - coating belt, 232 - - - coating belt supporting roller, 24 - - - pressing roller, 25 - - - guide plate, 251 - - - lower guide plate, 253 - - - auxiliary roller, 260 - - - liquid supplying means (pump),

261 - - - tank, 262 - - - drain pipe, 263 - - - valve, 264 - - - additive container, 265 - - - auxiliary tank, 27 - - - liquid injecting unit, 270 - - - valve for liquid injecting unit, 271 - - - accumulator, 280 - - - proller for rear face coating, 281 - - - liquid supplying nozzle for rear face coating, 282 - - - liquid supplying roller for rear face coating, 283 - - - valve for rear face coating, 290 - - - pressing belt, 291 - - - pressing belt supporting roller, 292 - - - guide for circumferential rotation, 293 - - - branching claw, 294 - - - compressed air generator, 295 - - - pressing roller with clamp , 296 - - - clamp, 30 - - - separating member belt, 31 - - - pressurizing roller, 310*a* - - - heater, 310*b* - - - heater, 32 - - - heating roller, 33 - - - conveying belt, 34 - - - belt supporting roller, 36 - - - separating claw, 37 - - - tension roller, 40 - - - cleaning member (scraper blade), 41 - - - foreign matter collecting box, 42 - - - cleaning member supporting roller, 51 - - - heating roller, 52 - - - drying belt, 61 - - - paper discharging tray, 62 - - - guide plate for discharging paper, 901 - - - paper feed tray, 902 - - - paper feed roller, 903 - - - guide plate, 904 - - - coating roller, 904' - - - conveying roller, 904" - - - high concentration liquid, 905 - - - separating roller, 906 - - - second process coating roller, 907 - - - low concentration liquid, 908 - - - heating roller, 909 - - - separating claw, 910 - - - toner cleaning portion, 911 - - - conveying roller, 912 - - - drying belt, and 913 - - - paper discharging tray

We claim:

1. A method for regenerating a fibrous recorded material capable of absorbing a liquid, the fibrous recorded material having an image recorded on a surface thereof by an image forming substance having a thermoplastic or thermally melting property, comprising the steps of:

applying an image removing accelerating liquid so as to wet the recorded material in at least a portion thereof having the image thereon;

repeating said applying step until a joining force between the recorded material and the image forming substance is reduced;

using a separating member to separate the image from the recorded material; and transferring the separated image to the separating member.

2. The method of claim 1 wherein the image removing accelerating liquid used in said applying step is different from the image removing accelerating liquid used in said repeating step.

3. The method of claim 2 wherein the image removing accelerating liquid comprises an aqueous solution including from 0.01 to 20 weight % of at least one of a surfactant and a water soluble polymer.

4. The method of claim 1 wherein the image removing accelerating liquid includes a surfactant, and wherein a concentration of the surfactant in the image removing accelerating liquid is sequentially reduced for each application of the image removing accelerating liquid in said applying and repeating steps.

5. The method of claim 4 wherein said applying and repeating steps include applying 16 $\mu g/cm^2$ to 1.6 $mg/cm^2$ of a high concentration liquid of the image removing accelerating liquid having an amount of the surfactant ranging from 5 to 100 weight %, and applying 16 $\mu g/cm^2$ to 3.2 $mg/cm^2$ of a low concentration liquid of the image removing accelerating liquid having no more than 5% of the surfactant.

6. The method of claim 5 wherein the repeating step comprises applying the low concentration liquid to a surface of the recorded material opposite that having an image recorded thereon.

7. The method of claims 5 or 6 wherein said high concentration liquid includes at least one wetting agent.

8. The method of claims 5 or 6 including the step of heating the recorded material joined to the separating member such that the surface thereof having the image recorded thereon has a temperature lower than that of a surface of the recorded material opposite that having the image recorded thereon.

9. An apparatus for regenerating a fibrous recorded material capable of absorbing a liquid, said fibrous recorded material having an image recorded on a surface thereof by an image forming substance having a thermoplastic or thermally melting property, comprising:

means for repeatedly applying an image removing accelerating liquid so as to wet the fibrous recorded material in at least a portion thereof having the image thereon;

a separating member positioned to be joined to the wetted recorded material and to separate the image from the wetted recorded material; and means using at least one of pressure and heat for transferring the image from the wetted recorded material joined to the separating member onto the separating member.

10. The apparatus of claim 9 including means for moving the recorded material toward said separating member, wherein said means for repeatedly applying an image removing accelerating liquid comprises a plurality of applying mechanisms arranged along the moving direction so as to sequentially apply the accelerating liquid to the recorded material.

11. The apparatus of claim 10 including a tank for storing the accelerating liquid to be supplied to the applying mechanisms.

12. The apparatus of claim 10 including means for supplying 16 $\mu g/cm^2$ to 1.6 $mg/cm^2$ of the accelerating liquid having a high concentration of 5 to 100 weight % of a surfactant to a more upstream one of said applying mechanisms, and for supplying 16 $\mu g/cm^2$ to 3.2 $mg/cm^2$ of the accelerating liquid having a low concentration of no more than 5 weight % of a surfactant to a more downstream one of said applying mechanisms.

13. The apparatus of claim 12 wherein at least said means for supplying the accelerating liquid having a low concentration comprises means for dropping the accelerating liquid onto the recorded medium.

14. The apparatus of claims 12 or 13 wherein said means for supplying the accelerating liquid having a low concentration comprises means for supplying the accelerating liquid to both sides of at least an upstream end of the recorded medium.

15. The apparatus of claim 13, further comprising means for judging the number of regenerative processings performed before the regenerative processing of the recorded material; and control means for changing the number of applications of the image removing accelerating liquid in accordance with the number of regenerative processings.

16. The apparatus of claim 15, wherein the regenerating apparatus further comprises control means for controlling the number of applications of the high concentration liquid in accordance with the number of regenerative processings performed and judged before the regenerative processing.

17. The apparatus of claim 13 including means for heating the recorded material joined to the separating member such that the surface thereof having the image recorded thereon has a temperature lower than that of a surface of the recorded material opposite that having the image recorded thereon.

* * * * *